US009653844B1

(12) United States Patent
Szeto

(10) Patent No.: US 9,653,844 B1
(45) Date of Patent: May 16, 2017

(54) ELECTRONIC DEVICE CONNECTORS WITH ROTATABLE ANCHORS

(71) Applicant: NANOPORT TECHNOLOGY INC., Markham (CA)

(72) Inventor: Timothy Jing Yin Szeto, Markham (CA)

(73) Assignee: NANOPORT TECHNOLOGY INC., Markham, Ontario ( * ) Notice: Subject to any disclaimer, the term of this patent is extended or adjusted under 35 U.S.C. 154(b) by 0 days.

(21) Appl. No.: 15/242,281

(22) Filed: Aug. 19, 2016

Related U.S. Application Data

(60) Provisional application No. 62/335,595, filed on May 12, 2016.

(51) Int. Cl.

| | |
|---|---|
| ***H01R 11/30*** | (2006.01) |
| ***H01R 13/60*** | (2006.01) |
| ***H01R 13/62*** | (2006.01) |
| ***H01R 43/26*** | (2006.01) |

(52) U.S. Cl.
CPC ..... *H01R 13/6205* (2013.01); *H01R 43/26* (2013.01)

(58) Field of Classification Search
CPC ..... H01R 13/6205; H01R 43/26
USPC ..... 439/39
See application file for complete search history.

(56) References Cited

U.S. PATENT DOCUMENTS

| | | | | |
|---|---|---|---|---|
| 3,363,214 | A | 1/1968 | Wright | |
| 6,561,815 | B1 | 5/2003 | Schmidt | |
| 7,311,526 | B2 | 12/2007 | Rohrbach et al. | |
| 7,322,873 | B2 | 1/2008 | Rosen et al. | |
| 7,344,380 | B2 | 3/2008 | Neidlein et al. | |
| 7,517,222 | B2 | 4/2009 | Rohrbach et al. | |
| 7,645,143 | B2 | 1/2010 | Rohrbach et al. | |
| 7,726,974 | B2 | 6/2010 | Shah et al. | |
| 7,901,216 | B2 | 3/2011 | Rohrbach et al. | |
| 8,187,007 | B2 | 5/2012 | Emde et al. | |
| 8,491,312 | B2 * | 7/2013 | Rudisill | H01R 11/30 439/39 |

(Continued)

FOREIGN PATENT DOCUMENTS

| | | |
|---|---|---|
| EP | 1865581 | 4/2012 |
| WO | 2014021847 | 2/2014 |
| WO | 2014184610 | 11/2014 |

OTHER PUBLICATIONS

International Search Report and Written Opinion for PCT/CA2015/000545 dated Jan. 8, 2016.

(Continued)

*Primary Examiner* — Javaid Nasri
(74) *Attorney, Agent, or Firm* — Norton Rose Fulbright Canada LLP

(57) ABSTRACT

An electronic device has an anchor assembly is movably mounted inside the device housing. The anchor assembly has a magnet portion and a ferromagnetic portion, and has a magnetic field that is stronger proximate the magnet portion than the ferromagnetic portion. The anchor assembly rotates between first and second positions, with the magnet portion facing an edge of the device housing for forming a connection with another device, and with the magnet portion facing away from the edge of the housing, respectively. A biasing member biases the connector to the second position by magnetic attraction.

20 Claims, 22 Drawing Sheets

(56) References Cited

U.S. PATENT DOCUMENTS

| | | | |
|---|---|---|---|
| 8,529,274 | B2 | 9/2013 | Li et al. |
| 8,894,419 | B1 | 11/2014 | Buelow |
| 9,019,718 | B2 | 4/2015 | Bdeir |
| 9,130,291 | B2 | 9/2015 | Poh |
| 9,160,102 | B1 | 10/2015 | Morgan et al. |
| 2005/0239261 | A1 | 10/2005 | Tai et al. |
| 2007/0072443 | A1 | 3/2007 | Rohrbach |
| 2012/0021619 | A1 | 1/2012 | Bilbrey et al. |
| 2012/0068942 | A1 | 3/2012 | Lauder et al. |
| 2012/0295451 | A1 | 11/2012 | Hyun-Jun et al. |
| 2013/0050958 | A1 | 2/2013 | Bdeir |
| 2013/0273752 | A1 | 10/2013 | Rudisill et al. |
| 2013/0323941 | A1 | 12/2013 | Zeliff et al. |
| 2014/0065846 | A1 | 3/2014 | Poh |
| 2015/0236444 | A1 | 8/2015 | Bdeir |

OTHER PUBLICATIONS

International Search Report and Written Opinion for PCT/CA2014/000803 dated Jan. 27, 2015.

* cited by examiner

ELECTRONIC DEVICE CONNECTORS WITH ROTATABLE ANCHORS

CROSS-REFERENCE TO RELATED APPLICATIONS

This application claims priority to U.S. provisional patent application No. 62/335,595, filed on May 12, 2016, the entire contents of which are incorporated herein by reference.

FIELD

This disclosure relates to magnetic connectors for connecting devices to one another.

BACKGROUND

Mobile electronic devices (e.g. mobile phones, tablet computers, laptop computers, or the like) are usually provided with a plurality of connection options which allow the devices to communicate with one another electronically, or to supply energy to the internal battery to recharge the battery, or to add functionality to the device, such as connecting a peripheral device (e.g., keyboard, mouse, speakers, or the like).

Connection of devices mechanically and/or electrically integrates the multiple devices to provide complementary functions. For some functions and some combinations of devices, it may be desirable for devices to be mechanically held together. One way to connect devices is to hold them together by magnetic attraction. Unfortunately, devices with magnets may have disadvantages. For example, magnets may inadvertently attract metallic objects such as keys, coins and the like.

SUMMARY

An example electronic device comprises: a housing; an anchor assembly movably mounted inside the housing, the anchor assembly comprising a magnet portion and a ferromagnetic portion, and having a magnetic field that is stronger proximate the magnet portion than the ferromagnetic portion, the anchor assembly rotatable between a first position with the magnet portion facing an edge of the housing for forming a connection with another electronic device, and a second position with the magnet portion facing away from the edge of the housing; and a biasing member for biasing the connector to the second position by magnetic attraction.

An example method of connecting a first electronic device to a second electronic device comprises: positioning the first device adjacent the second device; magnetically rotating an anchor assembly of the first device from a first position with a magnet portion facing inwardly and a ferromagnetic portion facing outwardly, to a second position with the magnet portion facing outwardly toward the second device for forming a connection, thereby overcoming a magnetic bias to the first position; and magnetically holding the first and second devices together with the anchor assembly.

An example magnetic connector for an electronic device comprises: an anchor assembly comprising a magnet portion and a ferromagnetic portion and having a magnetic field that is stronger proximate the magnet portion than the ferromagnetic portion, the anchor assembly configured for mounting in a housing of the electronic device, rotatable between a first position with the magnet portion facing inwardly and the ferromagnetic portion facing outwardly and a second position with the magnet portion facing outwardly for forming a connection with another device; and a biasing member for magnetically biasing the anchor assembly to the first position.

BRIEF DESCRIPTION OF DRAWINGS

In the figures, which illustrate, by way of example only, embodiments of the invention.

DETAILED DESCRIPTION

Figure 1A:
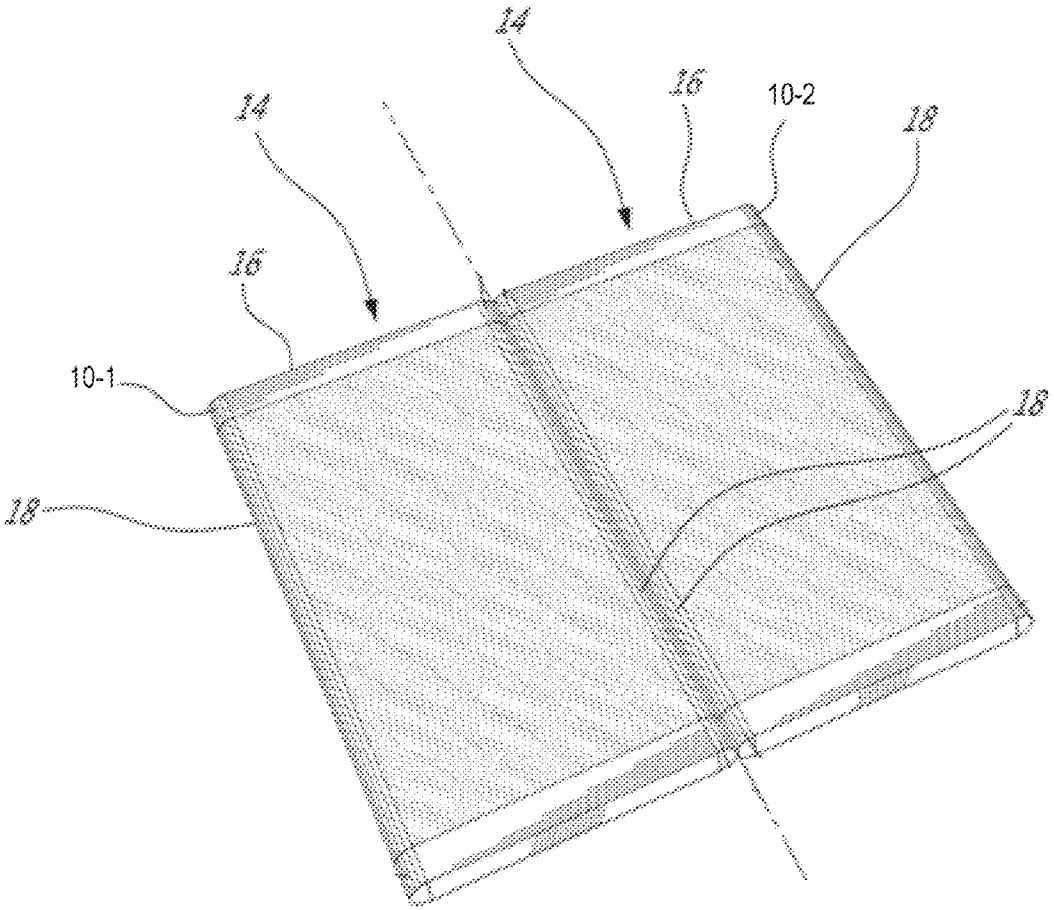
FIGS. 1A, 1B, and 1C are perspective views of a pair of electronic devices, in three respective configurations.
Figure 1B:
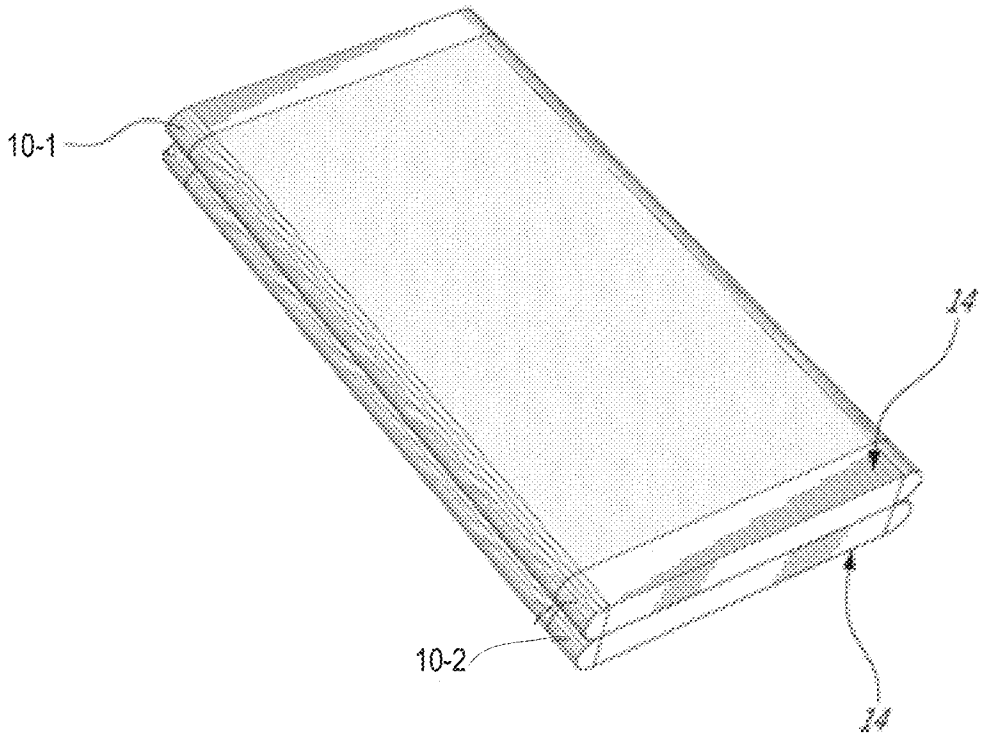
Figure 1C:
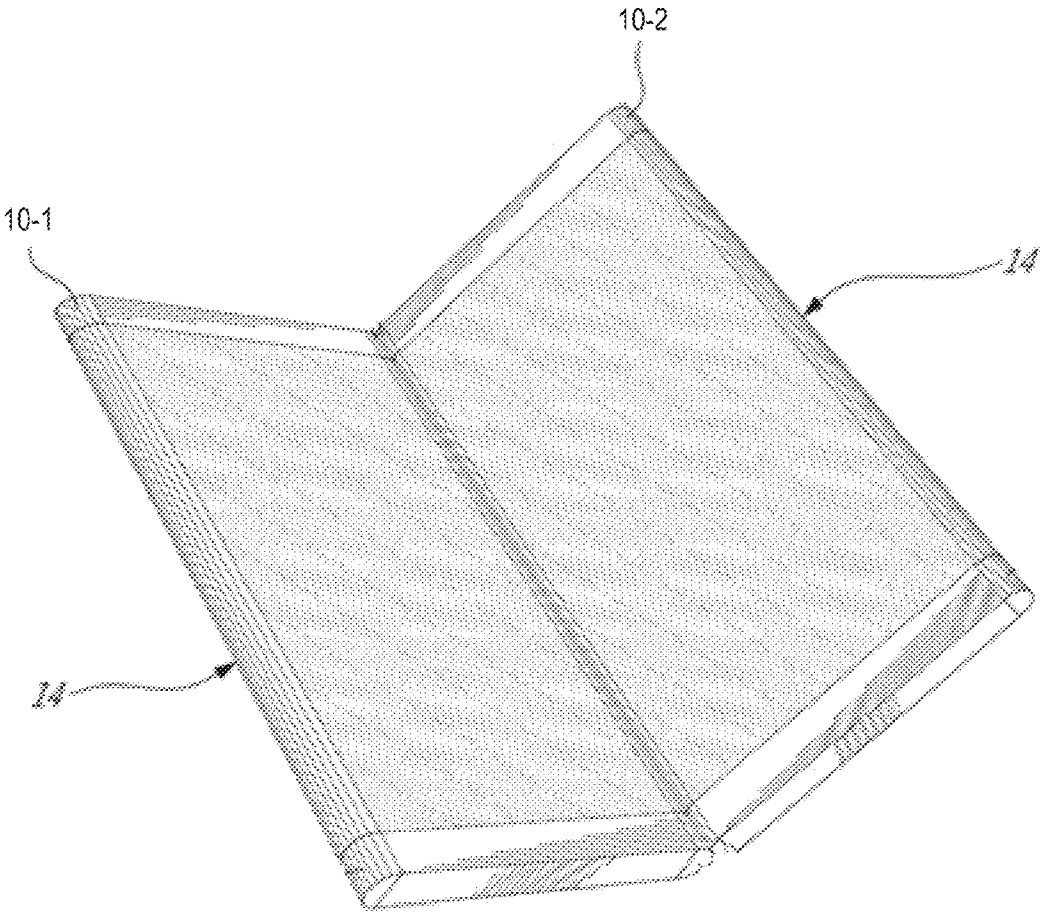

Referring now to FIGS. 1A, 1B and 1C, a pair of electronic devices 10-1, 10-2 (individually and collectively, devices 10) each include a housing 14 defined by contiguous external surfaces 16. The devices 10-1, 10-2 may be any electronic devices that interface with one another and provide complementary functions. As depicted, each device is a smartphone. In other embodiments, one device may be smartphone and the other an accessory, such as a speaker. As further examples, one of the devices may be a smartphone and the other a viewing screen, or both may be viewing screens, or one may be a screen and the other a keyboard; one device may be a touchscreen enabled device and the other a router to communicate to the Internet, or one may be a camera and the other a smart phone to store images from the camera. These examples are non-limiting and it will be apparent that many mutually complementary devices exist that benefit from interconnection and interoperation.

As shown in FIG. 1A, the devices 10-1, 10-2 may be arranged side by side with a pair of surfaces 16, e.g. lateral surfaces, juxtaposed, typically when in use, or, as shown in FIG. 1B, in a stacked configuration with a different pair of surfaces, e.g. front and back surfaces, juxtaposed for storage or for alternative functions.

Devices 10-1, 10-2 include connectors 100 at each corner of their respective housings. As will be described in further detail below, each connector may include one or more magnets movably mounted within the respective device housing 14. Such magnets may be made from rare earth materials, such as Neodymium-Iron-Boron (NdFeB), Samarium-cobalt, as are generally available. Such magnets may also be made from iron, nickel or other suitable alloys. Alternatively or additionally, each connector may include one or more members susceptible to movement by magnetic fields, e.g. metallic or ferromagnetic members. Indicators may be incorporated into the housing 14 to provide an indication of the state of the connectors 100 (e.g., the location or orientation of a magnet). The indicators may be conveniently made from a magnetically transparent material, such as aluminum or copper that also enhances the aesthetics of the casing.

Devices 10-1, 10-2 may be used in a variety of positions. For example, two devices may be placed side-by-side, with lateral surfaces 16 abutting, as shown in FIG. 1A. Devices may also be placed on top of one another, so that a top or bottom surface of one device abuts a top or bottom surface of another device as shown in FIG. 1B. In some embodiments, devices may be placed side-by-side and pivoted relative to one another, as shown in FIG. 1C. In each of the depicted orientations, respective connectors 100 of the two devices are positioned proximate one another. Other orientations are possible, as will be apparent.

With the devices 10-1, 10-2 in the position of FIG. 1A, a connector 100 of one device 10-1 is positioned adjacent a connector 100 of the other device 10-2. In this position, the magnets of the connectors 100 are adjacent one another. So positioned, the magnets of the adjacent connectors 100 may interact to magnetically or electrically engage one another. For example, one or more of magnets may slide or rotate so that that the respective north and south poles of adjacent magnets are aligned. As further detailed below, in some embodiments, once the magnets are engaged, an electrical connection may be formed for providing data and/or power paths. In some embodiments, the electrical connection may be formed through contacts disposed on housings 14, the contacts being in electrical communication with respective magnets. In another embodiment, the magnets may protrude through respective housing such that they contact each other directly. In other embodiments, electrical connections may be formed through leads carried by the magnets, rather than the magnets themselves.

Magnets of adjacent connectors 100 exert a significant magnetic force on one another. The magnets are mounted within the respective devices such that they are movable and cause one another to move such towards alignment of their respective magnetic fields. The magnets attract one another with sufficient strength to hold devices 10-1, 10-2 together in any of the configurations of FIGS. 1A-1C.

Figure 2A:
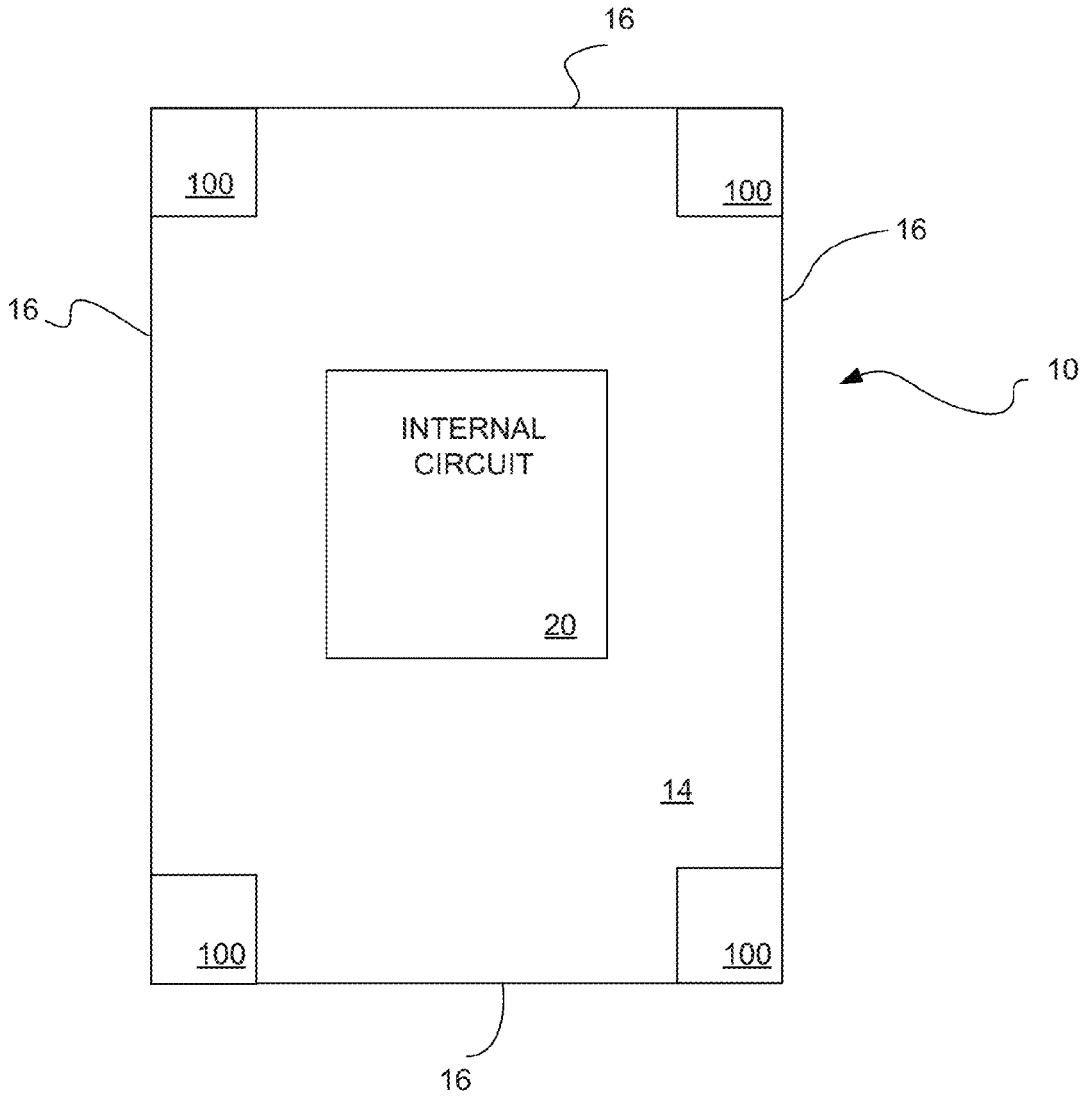
FIGS. 2A, 2B are schematic views showing components of an electronic device.

FIG. 2A depicts a schematic view of a device 10 in greater detail. As noted, device 10 is a smartphone. However, the disclosure herein is applicable to other types of electronic devices, such as a tablet computers, laptop computers, desktop computers, workstations, servers, portable computers, personal digital assistants, interactive televisions, video display terminals, gaming consoles, electronic reading devices, any other portable electronic device, or a combination of these. Device 10 may be integrated with a household appliance (e.g., a fridge, oven, washing machine, stereo, exercise bike, alarm clock, or the like), or a vehicle (e.g., on a vehicle dashboard).

Figure 2B:
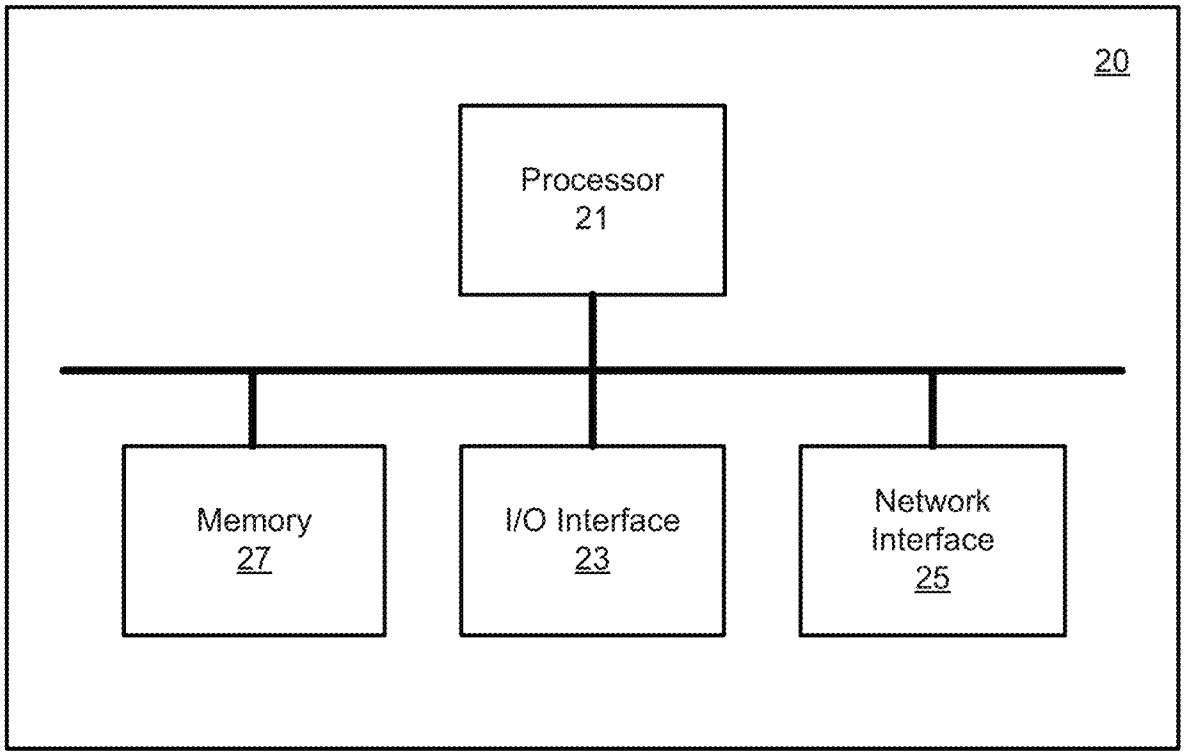
Figure 2E:
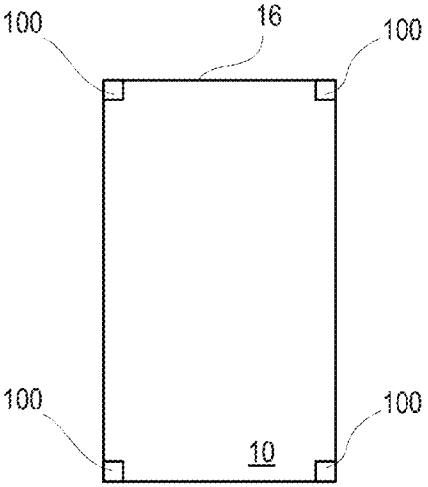
FIGS. 2C, 2D, 2E, 2F, 2G and 2H are schematic views showing locations of connectors on an electronic device.

Device 10 has a housing 14 defining front and rear surfaces and peripheral surfaces 16. Device 10 includes at least one internal circuit 20 which provides certain functions of device 10. for example, as depicted in FIG. 2B, internal circuit 20 may include a processor 21, an input/output (I/O) interface 23, a network interface such as a Wi-Fi or cellular radio 25, memory 27, and a power delivery circuit (not shown) for receiving power from an external input and converting or conditioning it for delivery to other components of device 10. Components of internal circuit 20 may be formed on a single semiconductor die such as a system-on-chip, or as a plurality of components formed on separate semiconductor chips, mounted to a printed circuit board.

Processor 21 may be any type of processor, such as, for example, any type of general-purpose microprocessor or microcontroller (e.g., an ARM™, Intel™ x86, PowerPC™, Qualcomm™, Mediatek (MTK)™, Samsung™, Apple™ processor or the like), a digital signal processing (DSP) processor, an integrated circuit, a programmable read-only memory (PROM), or any combination thereof.

Memory 27 may include a suitable combination of any type of electronic memory that is located either internally or externally such as, for example, random-access memory (RAM), read-only memory (ROM), compact disc read-only memory (CDROM), electro-optical memory, magneto-optical memory, erasable programmable read-only memory (EPROM), and electrically-erasable programmable read-only memory (EEPROM), or the like.

I/O interface 23 enables device 10 to communicate through connectors 100, e.g., to interconnect with other devices 10. I/O interface 23 also enables device 10 to interconnect with various input and output peripheral devices. As such, device 10 may include one or more input devices, such as a keyboard, mouse, camera, touch screen and a microphone, and may also include one or more output devices such as a display screen and a speaker.

Network interface 25 enables device 10 to communicate with other devices (e.g., other devices 10) by way of a network.

Device 10 may be adapted to operate in concert with one or more interconnected devices 10. In particular, device 10 may store software code in memory 27 and execute that software code at processor 21 to adapt it to operate in concert with one or more interconnected devices 10. The software code may be implemented in a high level procedural or object oriented programming or scripting language, or a combination thereof. The software code may also be implemented in assembly or machine language.

As noted, device 10 also includes a plurality of connectors 100 for connecting device 10 to external devices. Each connector 100 may be capable of connecting device 10 with, for example, smartphones, speakers, power supplies input/output peripherals or the like. Connectors 100 may be connected to one or more components of internal circuit 20 for data or power transmission. In some embodiments, connectors 100 may for example provide universal serial bus (USB) connections to external devices. Device 10 may act as a host or client device using such connections.

Figure 2D:
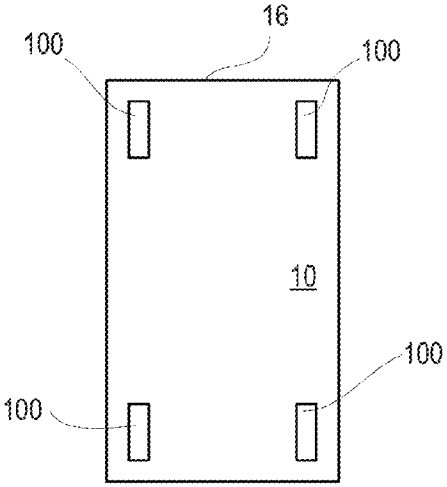
Figure 2C:
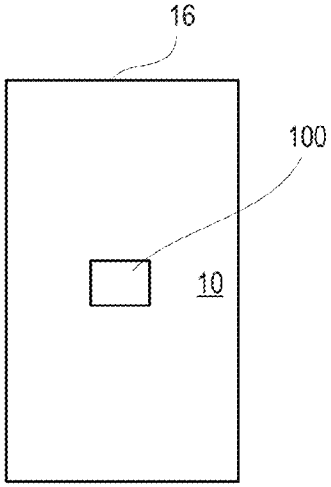
Figure 2H:
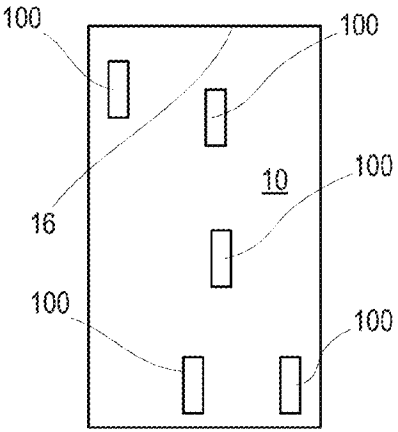
Figure 2G:
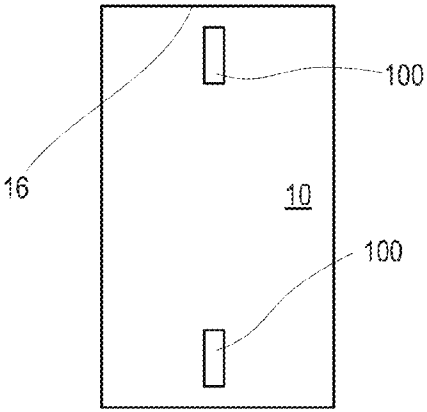
Figure 2F:
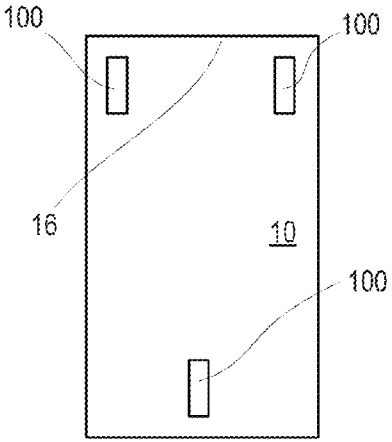

For enhanced flexibility, it will be appreciated that a connector 100 may be provided at each corner of the housing 14, as depicted in FIG. 2A, is preferred. However, in different devices, it may not be necessary to provide a connector in each corner, but rather distribute the connectors about the housing at convenient locations. FIGS. 2C-2H illustrate, non-exhaustively, a variety of possible locations. Thus, connectors 100 may be located centrally, as shown in FIG. 2C, inset from each corner as shown in FIG. 2D or at the corners as described above and shown in FIG. 2E. It is also possible to arrange the connectors so that only a preferred orientation is available, for example by arranging the connectors at the apexes of a triangle as shown in FIG. 2F, or only selected areas of the housing 14 as shown in FIG. 2H. A flexible orientation can be provided by arranging the connectors along a major axis of the housing 14 as shown in FIG. 2G so that the connection is attained in either of two positions.

As noted above, in some embodiments, the magnets may be utilized to connect the devices both mechanically and electrically.

Figure 3A:
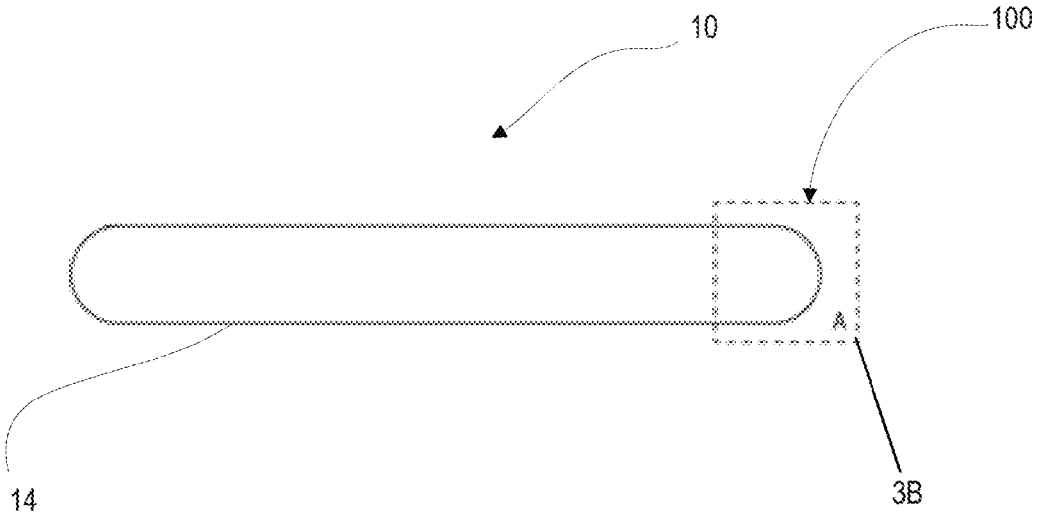
FIGS. 3A-3B are partial side cross-sectional views of an electronic device, showing a connector.
Figure 3B:
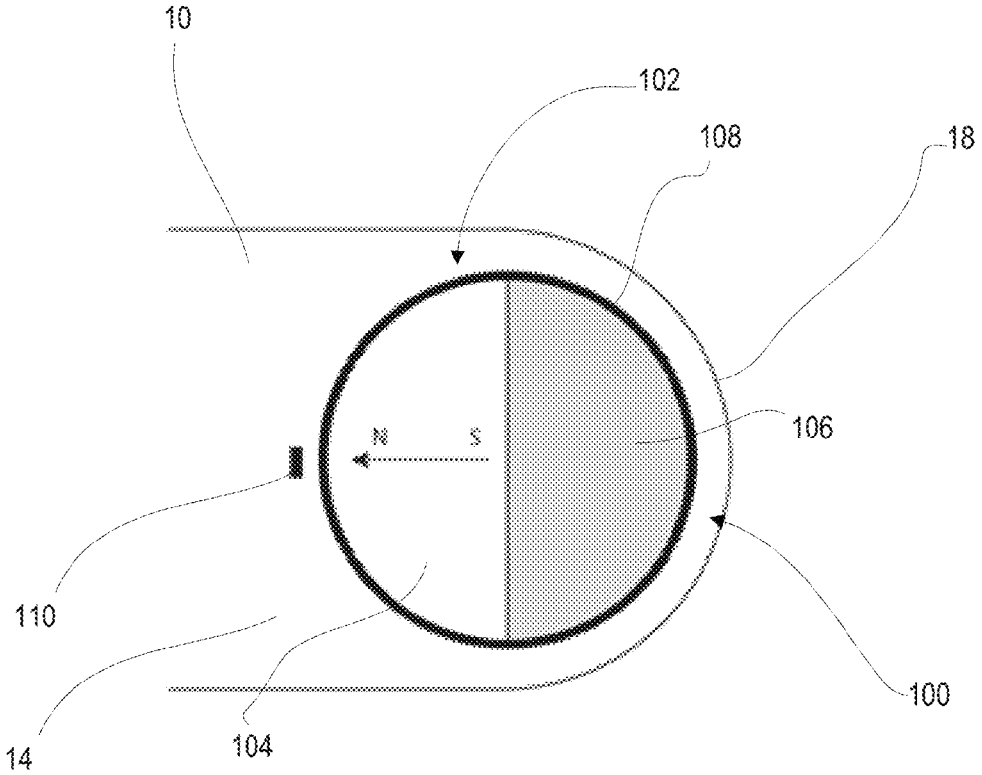

FIG. 3A depicts an end elevation view of device 10 showing the location of an example connector 100. FIG. 3B depicts an enlarged portion of device 10, indicated by box 3B shown in broken lines in FIG. 3A.

As shown in FIG. 3B, connector 100 has an anchor 102 with a first portion 104 and a second portion 106. Anchor 102 is rotatably mounted in device 10. For example, in the depicted embodiment, anchor 102 is received in a cavity 108 defined in housing 14 of device 10 proximate a lateral edge 18. In the depicted embodiment, cavity 108 is larger than anchor 102, with sufficient clearance to permit free rotation of anchor 102. In some embodiments, anchor 102 may be attached to housing 14, e.g., using a pin about which anchor 102 can rotate.

First portion 104 is permanently magnetized, having north and south poles, and generates a magnetic field. First portion 104 may be, for example, a rare earth magnet such as neodymium-iron-boron or samarium-cobalt, or a magnet formed from iron, steel, cobalt, nickel, or other suitable alloy. Second portion 106 is not permanently magnetized, or is a weaker permanent magnet than first portion 104, generating a weaker magnetic field. Second portion 106 may be ferromagnetic, such that it is capable of magnetic attraction. Second portion 106 may, for example, be formed of a ferromagnetic material such as iron, steel, cobalt, nickel, or an alloy thereof.

First portion 104 and second portion 106 may be joined to one another, for example, by magnetic attraction, using an adhesive, or by another suitable method. As depicted in FIG. 3B, first portion 104 and second portion 106 meet at a planar interface. However, in other embodiments, the interface between first portion 104 and second portion 106 may be non-planar.

First portion 104 may have any suitable magnetic orientation. For example, as depicted, the north-south poles of first portion 104 are aligned substantially perpendicular to the interface between first portion 104 and second portion 106. In other embodiments, the north-south poles may be aligned parallel to the interface, or in another orientation.

Figure 3C:
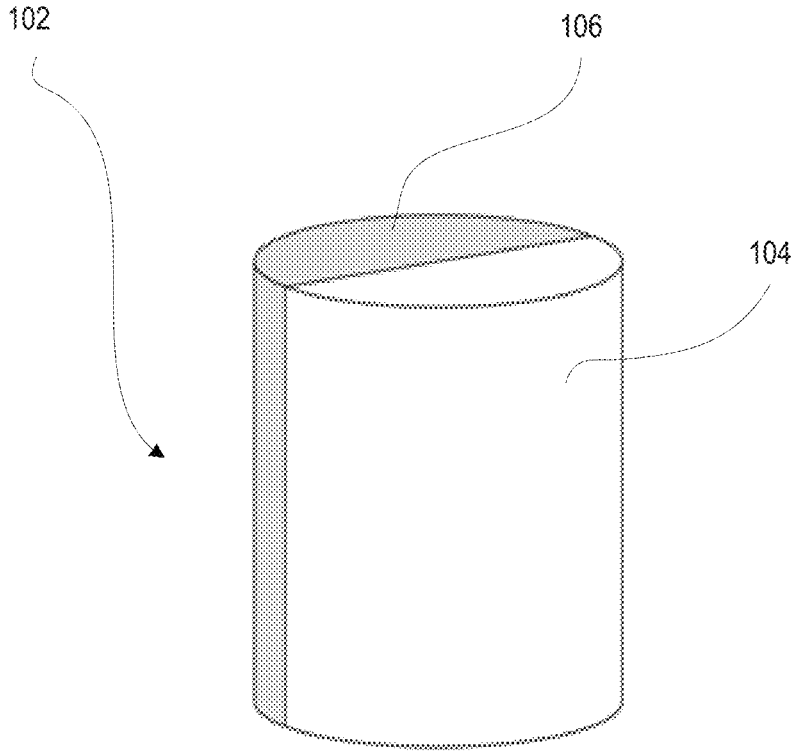
FIG. 3C is a perspective view of an anchor of the device of FIGS. 3A-3B.

FIG. 3C depicts a perspective view of anchor 102, removed from housing 14. As depicted, anchor 102 is cylindrical and is rotatable about its longitudinal axis. Each of first portion 104 and second portion 106 is semi-cylindrical. In other embodiments, anchor 102 may be spherical, with each of first portion 104 and second portion 106 being semi-spherical. In still other embodiments, anchor 102 may have other shapes, such as rounded shapes, suitable for movement within cavity 108 as described herein.

Figure 4A:
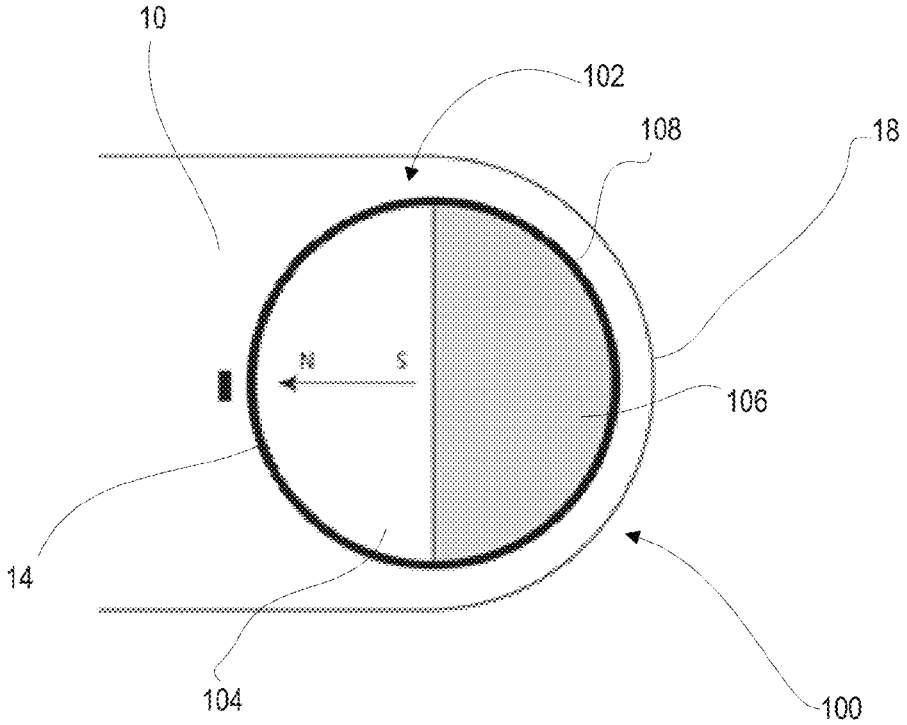
FIGS. 4A-4B are partial side cross-sectional views of the device of FIGS. 3A-3B, in different operational states.
Figure 4B:
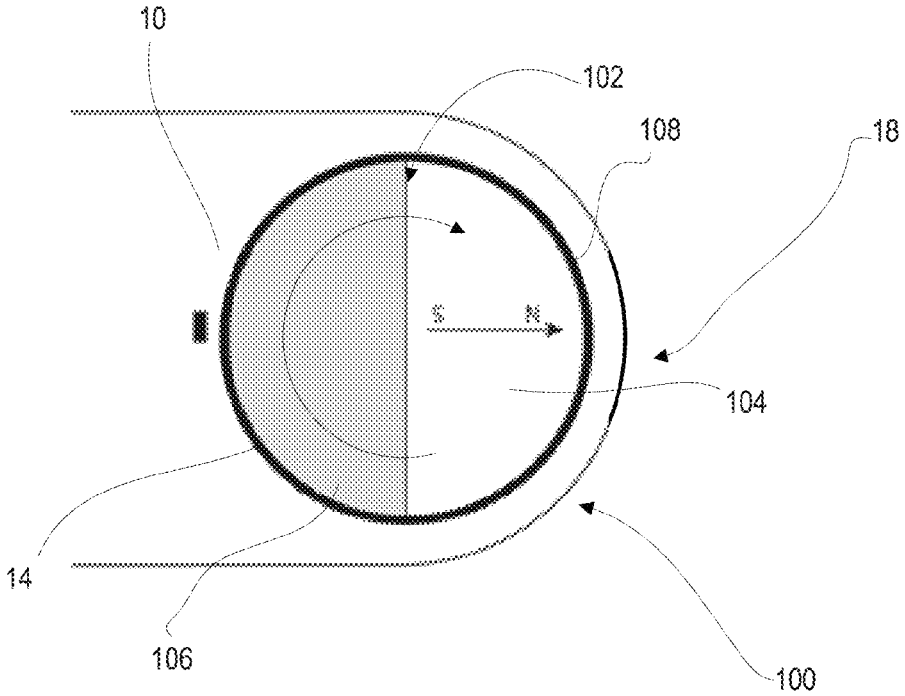

Anchor 102 is movable within cavity 108 of housing 14 between a first position in which first portion 104 faces outwardly (i.e. toward an edge 18 of housing 14), as depicted in FIG. 4A and a second position in which first portion 104 faces inwardly (i.e, away from an edge of housing 14), as depicted in FIG. 4B. For example, as shown in FIG. 4B, anchor 102 may rotate as indicated by arrow R. Alternatively, anchor 102 may rotate in the opposite direction. In other embodiments, such as when anchor 102 is spherical, anchor 102 may rotate in other directions or about other axes.

The magnetic field associated with anchor 102 creates a magnetic flux at the surface of housing 14. In particular, the magnetic field may extend past edge 18 and create a magnetic flux at edge 18. In the first position, namely, the position of FIG. 4A, first portion 104 of anchor 102 is positioned proximate edge 18, such that the magnetic field surrounding edge 18 and the magnetic flux at edge 18 is primarily that associated with first portion 104. Conversely, in the position of FIG. 4B, second portion 106 of anchor 102 is positioned proximate edge 18, while first portion 104 is withdrawn away from edge 18, and the effect of its magnetic field at edge 18 is correspondingly reduced.

As noted, second portion 106 of anchor 102 may be a relatively weak magnet, or may have no permanent magnetic field. Accordingly, in the first position of anchor 102, depicted in FIG. 4A, the magnetic field surrounding edge 18, if any, may be relatively weak, such that anchor 102 does not exert a significant attractive force on an anchor 102 of a another device positioned proximate thereto.

Conversely, in the second position, shown in FIG. 4B, a relatively strong magnetic field may surround edge 18. That is, since first portion 104 of anchor 102 is a relatively strong magnet and is positioned proximate edge 18 in the second position, the magnetic field generated by first portion 104 is strong proximate edge 18. In this state, anchor 102 may exert a significant attractive force on an anchor 102 of a device positioned proximate edge 18, urging the anchors 102 to connect. Accordingly, the first position (FIG. 4A) may be referred to herein as an inactive position and the second position (FIG. 4B) may be referred to herein as an active position.

A biasing member 110 is provided proximate anchor 102, positioned inwardly within housing 104. Biasing member 110 interacts with anchor 102 to bias anchor 102 to its inactive position. For example, as depicted, biasing member 110 is a block of ferromagnetic material, such as iron, steel, cobalt, nickel or an alloy thereof. Biasing member 110 is positioned sufficiently close to anchor 102 to interact with the magnetic field of first portion 104 in both the active and inactive positions. Specifically, first portion 104 magnetically attracts biasing member 110, and since anchor 102 is free to rotate, the magnetic attraction urges anchor 102 to move so that first portion 104 is close to biasing member 110, i.e. the inactive position. Biasing member 110 may be a weak permanent magnet or a non-permanently magnetized ferromagnetic block.

Figure 5A:
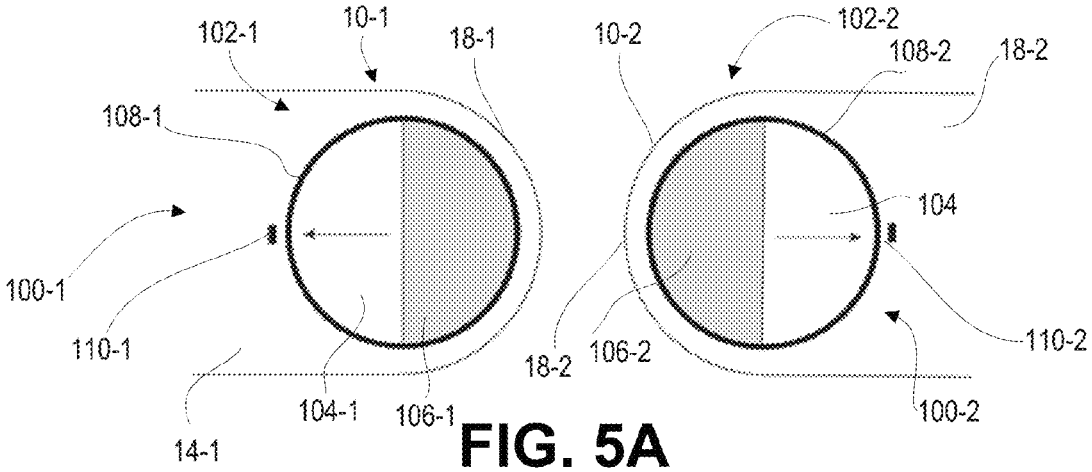
FIGS. 5A-5C are partial side cross-sectional views of two electronic devices in different connection states.
Figure 5B:
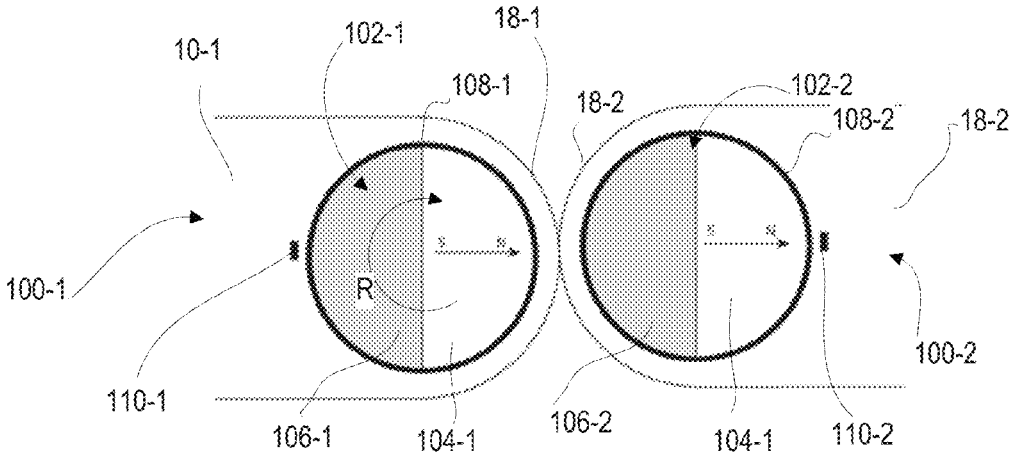
Figure 5C:
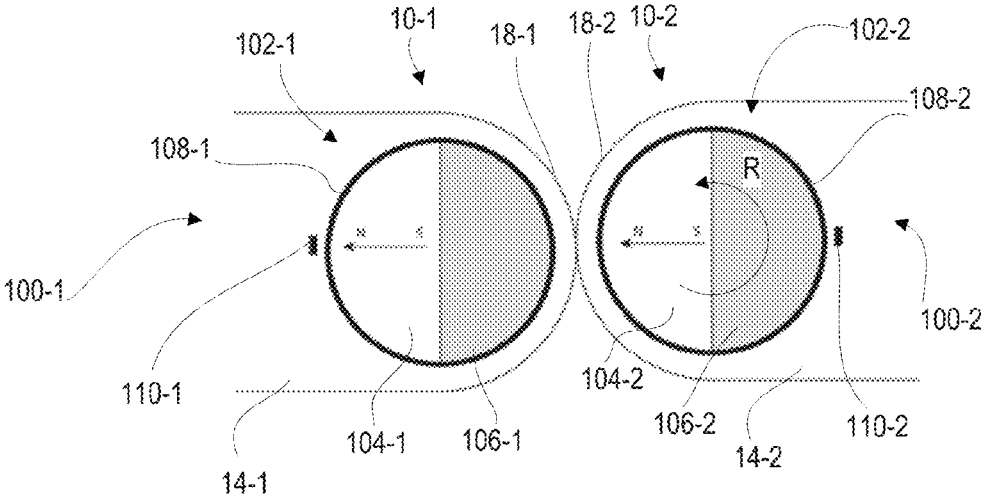

FIG. 5A-5C depict a pair of electronic devices 10-1, 10-2. In FIG. 5A, devices 10-1, 10-2 are spaced apart from one another. Anchors 102-1, 102-2 are both in their inactive positions, under the effect of biasing members 110-1, 110-2, respectively. First portions 104-1, 104-2 face inwardly. With devices 10-1, 10-2 spaced apart in this manner, interaction of their magnetic fields is relatively weak. In particular, each first portion 104 attracts its respective biasing member 110 more strongly than it does the opposing anchor 102. Accordingly, both of anchors 102-1, 102-2 remain in the inactive position.

FIGS. 5B-5C depict devices 10-1, 10-2 positioned adjacent one another. As depicted, device 10-1, 10-2 lie in a generally planar arrangement. However, other orientations are possible.

Magnetic attraction between anchors 102 increases as distance between devices 10 decreases. Once the distance passes a threshold value, attraction between at least one of first portions 104 and the opposing anchor 102 exceeds that between the first portion 104 and its biasing member 110. As a result of this magnetic attraction, the anchor moves (rotates) within its cavity 108 so that the magnetic poles of the anchors align. As depicted in FIG. 5B, attraction between first portion 104-1 and anchor 102-2 causes anchor 102-1 to rotate as indicated by arrow R into the active position, with first portion 104-1 facing outwardly. Alignment of anchors 102 increases magnetic attraction between anchors 102, such that the attraction connects (e.g. mechanically holds together) devices 10-1, 10-2.

FIG. 5C likewise depicts devices 10-1, 10-2 being positioned adjacent one another, and anchors 102 rotating into alignment to mechanically connect devices 10-1, 10-2. However, as shown in FIG. 5C, anchor 102-2 rotates within its cavity 108-2 to align with anchor 102-1. Either one of anchors 102 may rotate, and the anchor which rotates may depend, for example, on the relative strengths of first portions 104-1, 104-2 and biasing members 110-1, 110-2, fit of anchors 102-1, 102-2 within cavities 108-1, 108-2 and friction on anchors 102-1, 102-2, and other factors.

Attraction between anchors 102 is sufficient to overcome biasing members 110 once the distance between anchors 102 is less than a threshold distance. This threshold distance may depend on characteristics of the anchors 102 and devices 10. For example, the threshold distance may tend to increase as the distance between biasing member 110 and cavity 108 (and thus, anchor 102) increases. Conversely, the threshold distance may tend to decrease as the magnetic strength, if any, of biasing member 110 increases. That is, if biasing member 110 is a magnet, as opposed to a non-magnetized ferromagnetic member, the anchor may need to be positioned more closely to another anchor in order to overcome attraction between first portion 104 and biasing member 110. Similarly, if biasing member is placed close to anchor 102, the biasing effect will be strong and the anchor 102 may need to be positioned closely to another anchor to overcome the biasing effect, while if biasing member 110 is placed farther away from anchor 102, the biasing effect may be weaker and may be overcome with anchors 102 at a relatively larger distance from one another.

When devices 10 are positioned closely together, anchors 102 assume the positions depicted in FIG. 5B or FIG. 5C and magnetically attract one another with sufficient strength to mechanically hold the devices together. However, when devices 10 are spaced apart from one another, anchors 102 adopt their inactive positions. Thus, when two devices are brought together to form a connection, magnetic fields are concentrated about edges 18. At other times, magnetic fields around edges 18 are weaker and magnetic flux through each edge 18 is lower.

Figure 6A:
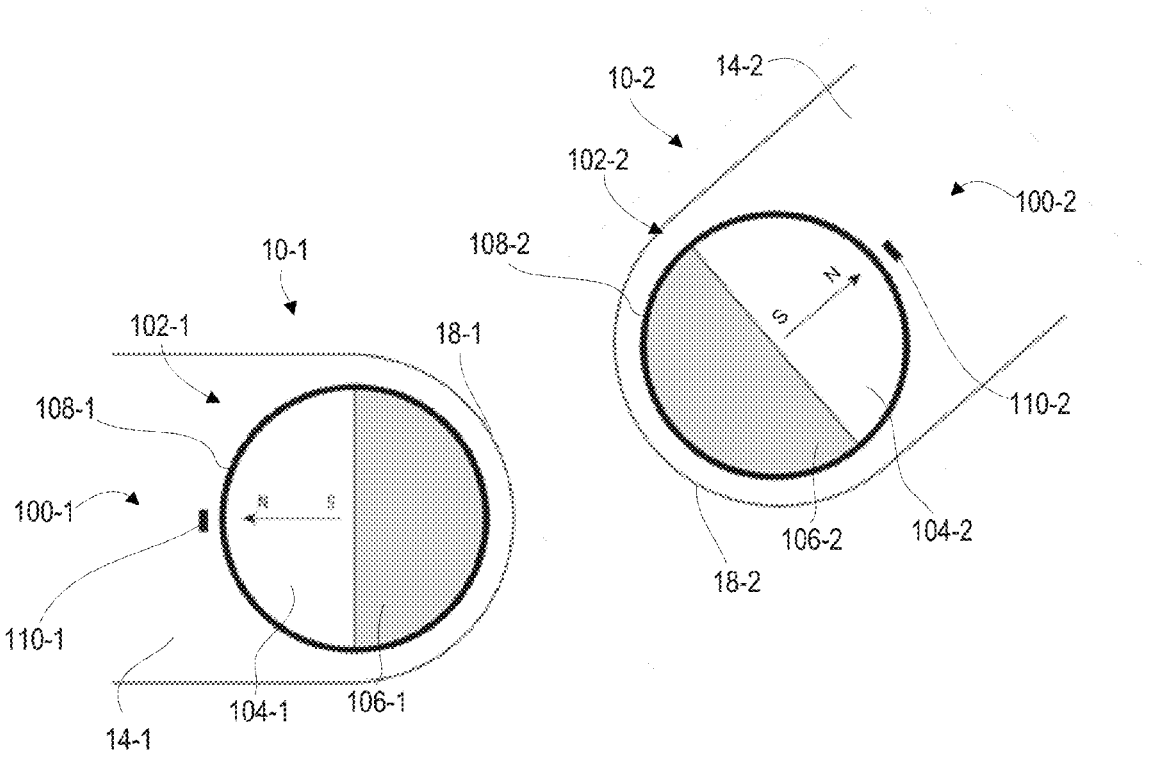
FIGS. 6A-6B are partial side cross sectional views of two electronic devices in different connection states.
Figure 6B:
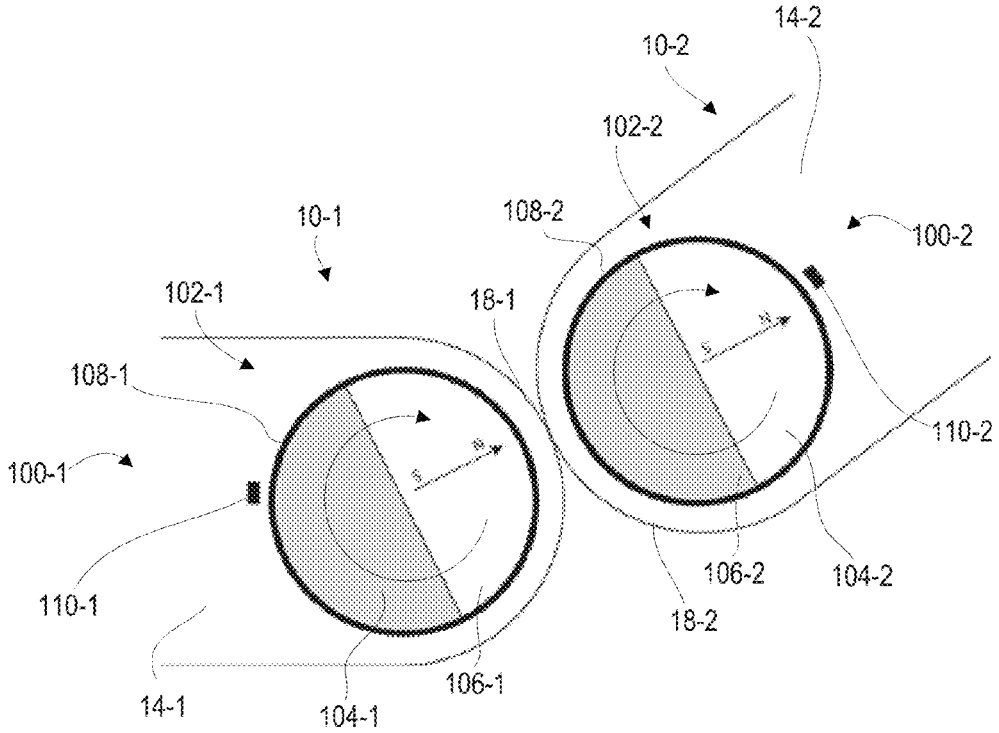

Devices may be brought together and connected in any orientation. For example, FIGS. 6A and 6B depict connection of devices 10-1, 10-2 at an angle to one another. As shown in FIG. 6A, devices 10-1, 10-2 are spaced apart from one another, and their respective connectors 102-1, 102-2 are biased to their inactive positions.

As devices 10-1, 10-2 are brought together and come within a threshold distance from one another, magnetic attraction between anchors 102 overcomes magnetic attraction between first portion 104-1 and biasing member 110. Accordingly, anchor 102-1 rotates away from its inactive position to an active position in which anchor 102-1 is magnetically aligned with anchor 102-2.

The magnetic orientations of anchors 102 need not correspond to the physical devices 10 in which anchors are housed. For example, where devices 10-1, 10-2 are at an angle to one another, as is depicted in FIG. 6B, anchor 102-1 is oriented such that its magnetic poles are at an angle to the body of device 10-1. Similarly, anchor 102-2 is oriented such that its magnetic poles are at an angle to device 10-2. Magnetic interaction between anchors 102 causes both anchors 102 to rotate to this position.

Figure 7B:
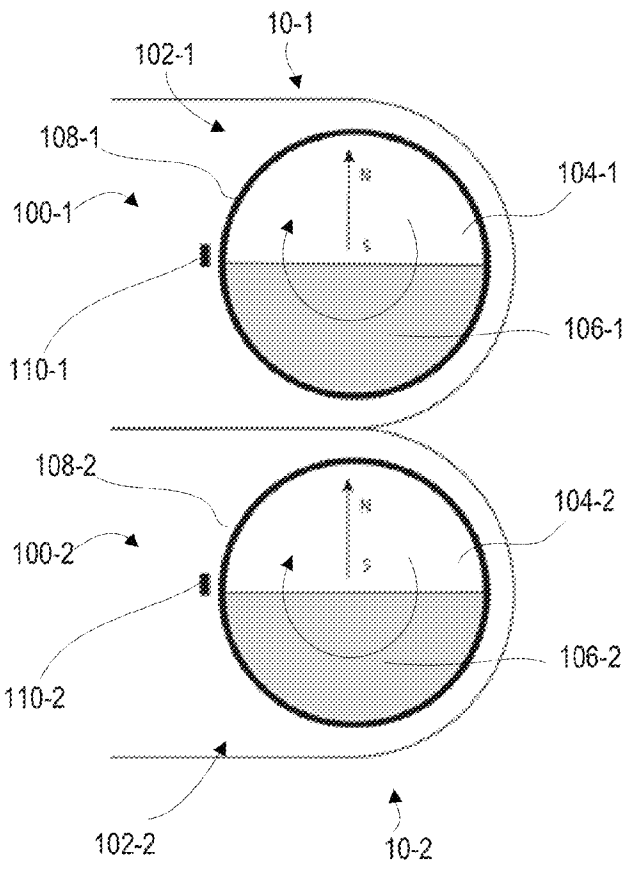
FIGS. 7A-7B are partial side cross sectional views of two electronic devices in different connection states.
Figure 7A:
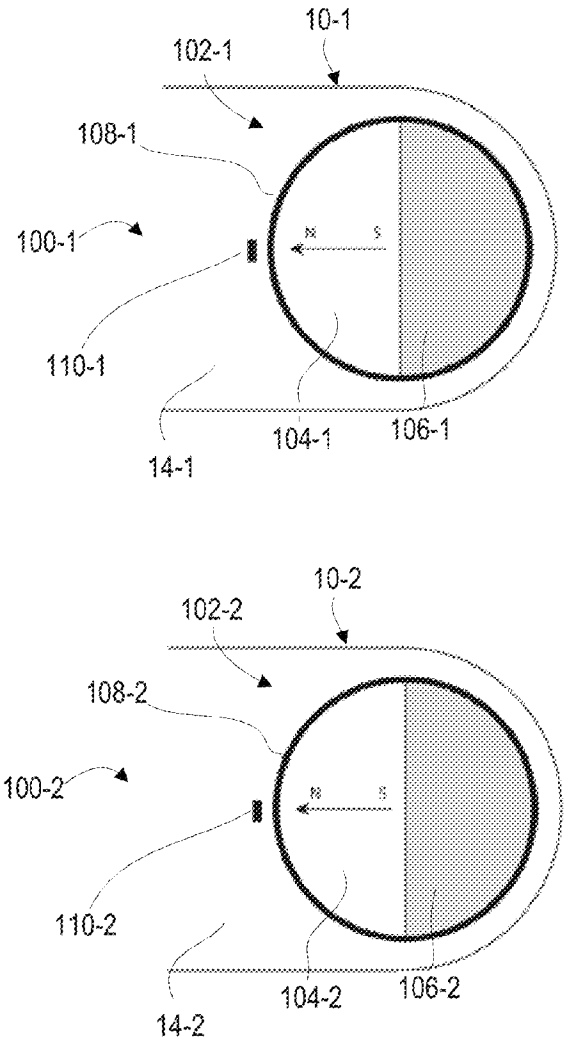

As shown in FIGS. 5A, 5B and 5C and 6A and 6B, devices 10-1, 10-2 are connected by bringing lateral edges 18-1, 18-2 into proximity with one another. In some embodiments, devices 10-1, 10-2 may be connected by bringing front or rear surfaces into proximity. For example, as depicted in FIG. 7A, devices 10-1, 10-2 are spaced apart from one another, with a back surface of device 10-1 opposing a front surface of device 10-2. Anchors 102-1, 102-2 are in their inactive positions due to interaction with the respective biasing member 110-1, 110-2.

Devices 10-1, 10-2 are brought towards one another, and once anchors 102 are within a threshold distance, magnetic interaction between anchors 102-1, 102-2 overcomes the effect of biasing members 110-1, 110-2. Both of anchors 102-1, 102-2 rotate into alignment with one another and form a connection between devices 10-1, 10-2 by magnetic attraction.

Once connected, devices 10-1, 10-2 may be pivoted relative to one another about edges 18 as shown in FIGS. 1A-1C, without breaking the connection. For example, devices 10-1, 10-2 may initially be connected in the position of FIG. 1A (corresponding to the anchor state of FIG. 5B or 50C). One device, e.g. device 10-2, may be pivoted around edges 18, to the position depicted in FIG. 1C (corresponding to the anchor state of FIG. 6B) or to the position depicted in FIG. 1B (corresponding to the anchor state of FIG. 7B). Anchors 102-1, 102-2 may maintain connection of the devices 10-1, 10-2 throughout this rotation. Rotation of device 10-2 may also cause rotation of one or both of anchors 102-1, 102-2 within their respective cavities. Specifically, as the devices are rotated, the anchors may likewise rotate to maintain alignment with one another.

Figure 8B:
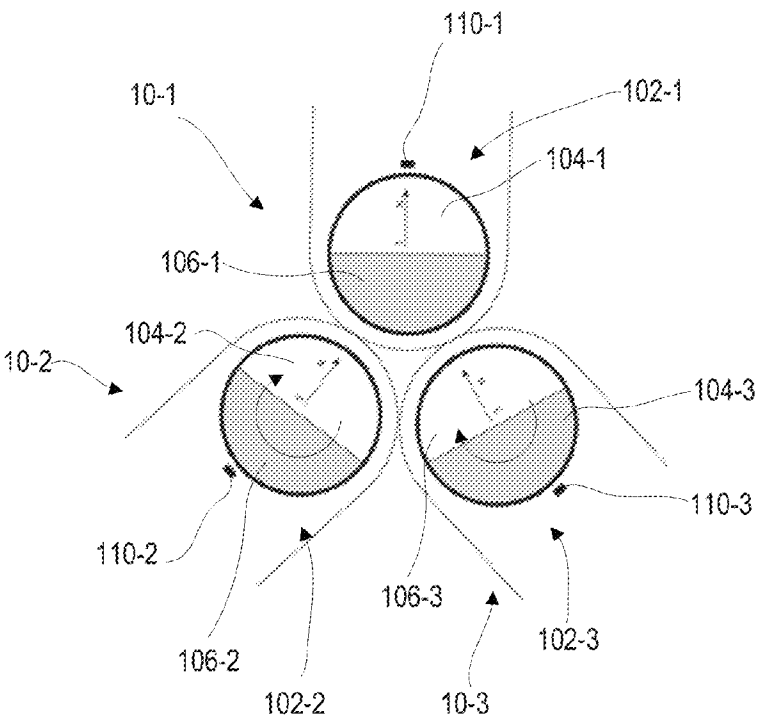
FIGS. 8A-8B are partial side cross sectional views of three electronic devices in different connection states.
Figure 8A:
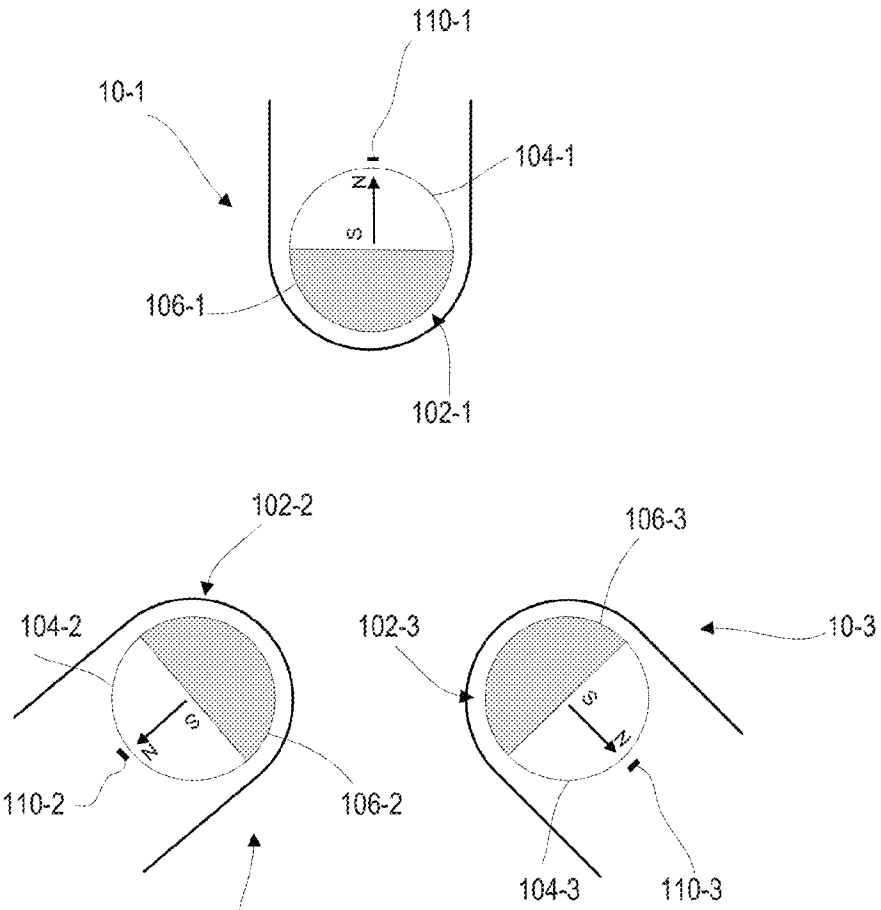

In some embodiments, three or more devices may be simultaneously connected. As depicted in FIG. 8A, three devices 10-1, 10-2, 10-3 are spaced apart from one another, and angled relative to one another. Anchors 102-1, 102-2, 102-3 of the devices are all biased to their inactive positions.

As devices 10-1, 10-2, 10-3 are brought together within a threshold distance, attraction between anchors 102-1, 102-2, 102-3 causes the anchors to move from their inactive positions. Anchors 102-1, 102-2, 102-3 rotate to an equilibrium position in which their magnetic poles may not perfectly align with one another, but are collectively aligned as closely as possible. In this position, anchors 102-1, 102-2, 102-3 mutually attract one another and magnetically pull devices 10-1, 10-2, 10-3 into connection.

Figure 9:
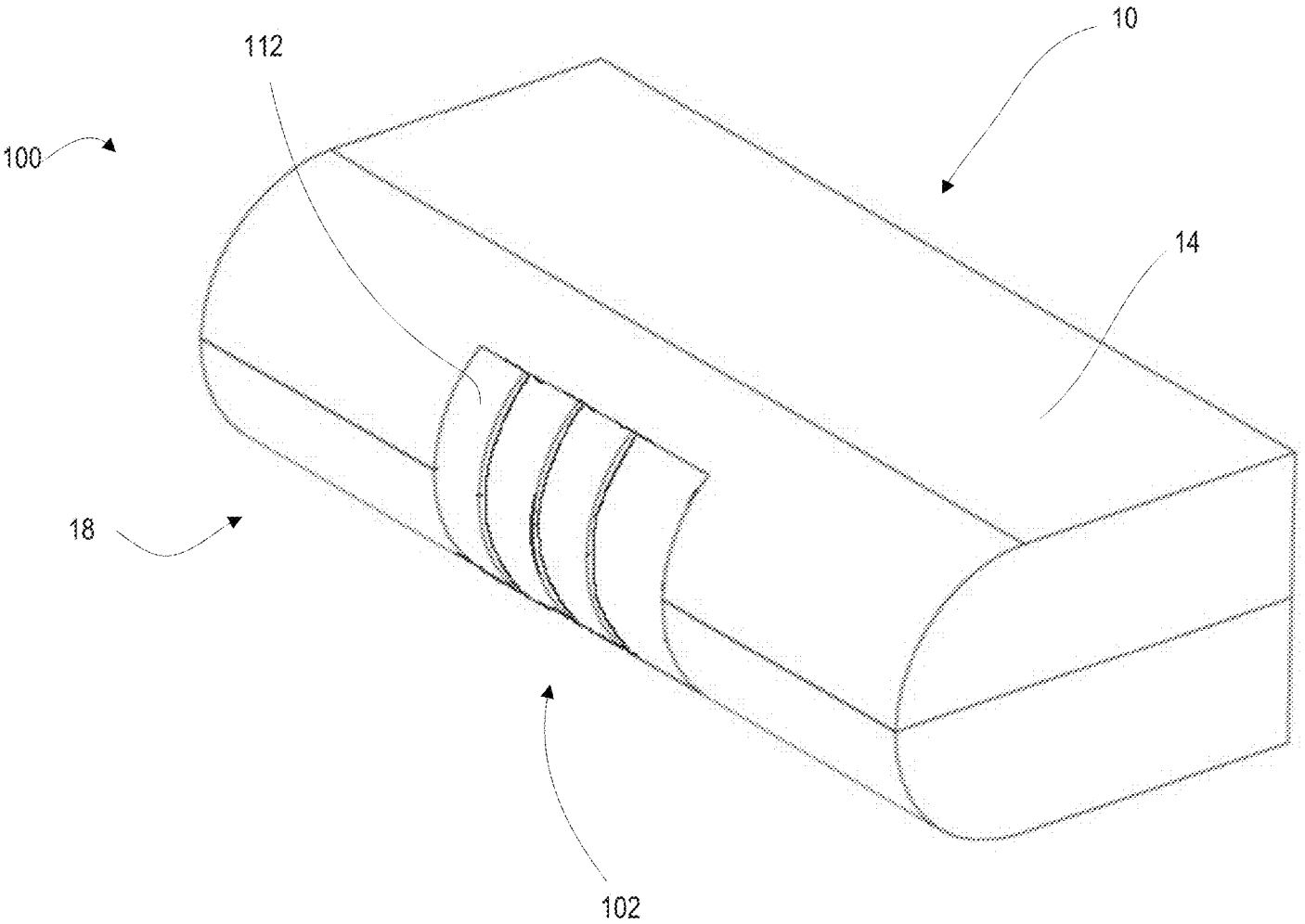
FIG. 9 is a partial perspective view of the device of FIGS. 3A-3B, showing electrical contacts.

In some embodiments, anchors 102 may form at least one electrical connection between devices 10-1, 10-2. For example, FIG. 9 depicts an example device 10 with electrical contacts 112 disposed on edge 18 of housing 14, adjacent anchor 102. When connected to another device, anchor 102 may bear against contacts 112, urging them outwardly into connection with corresponding contacts of the other device. Contacts 112 may be interconnected with an internal circuit of device 10, for example, for transmission of power or data signals. In some embodiments, contacts 112 may be capable of forming a data connection according to a universal serial bus (USB) standard, such as USB 1.0, USB 1.1, USB 2.0, USB 3.0 or the like. Alternatively or additionally, contacts 112 may be capable of carrying power to or from device 10, e.g. to receive input from a power supply or to provide power to a peripheral or accessory device.

In some embodiments, anchor 102 itself may serve as one or more electrical contacts. For example, anchor 102 may extend through a window in edge 18 of housing 14 to physically and electrically contact a corresponding anchor of another device. In such embodiments, each of first portion 104 and second portion 106 of anchor 102 may have a plurality of electrically-isolated sections. Each of the sections may carry a different electrical signal (e.g. a positive, negative, ground or Vcc signal of a USB connection).

As described above, biasing member 110 is a ferromagnetic member which is not permanently magnetized, but which interacts with (i.e. is attracted by) nearby magnets. In other embodiments, the biasing member may be a permanent magnet oriented to attract anchor 102 to its inactive position. In such embodiments, biasing member 110 may be a substantially weaker magnet than first portion 104, so that first portion 104 is capable of being drawn away from the biasing member in order to form a connection with another anchor.

Figure 10B:
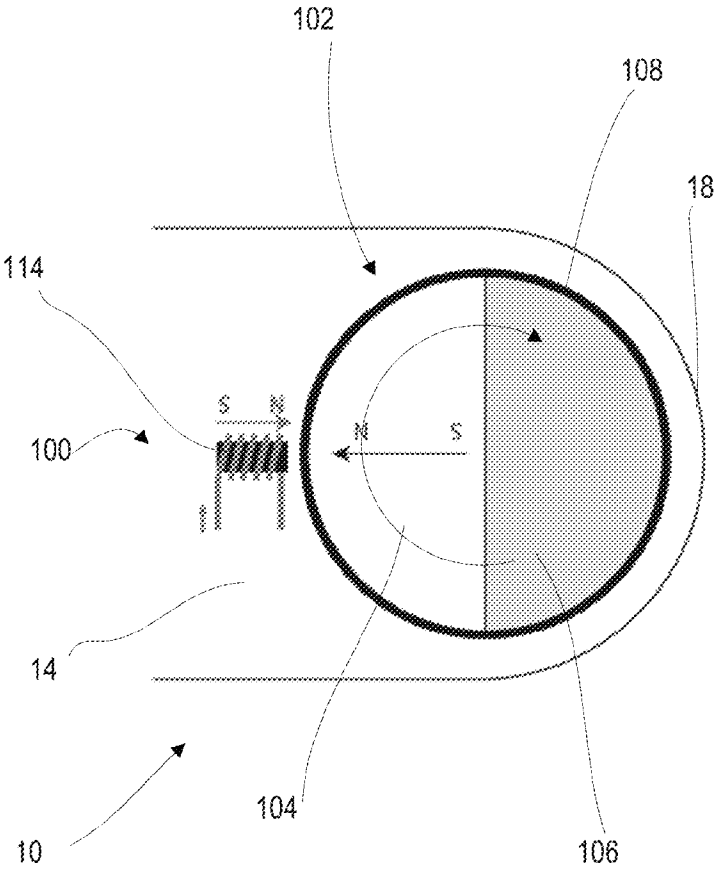
FIGS. 10A-10C are partial side cross-sectional views of another electronic device, in different operational states.
Figure 10A:
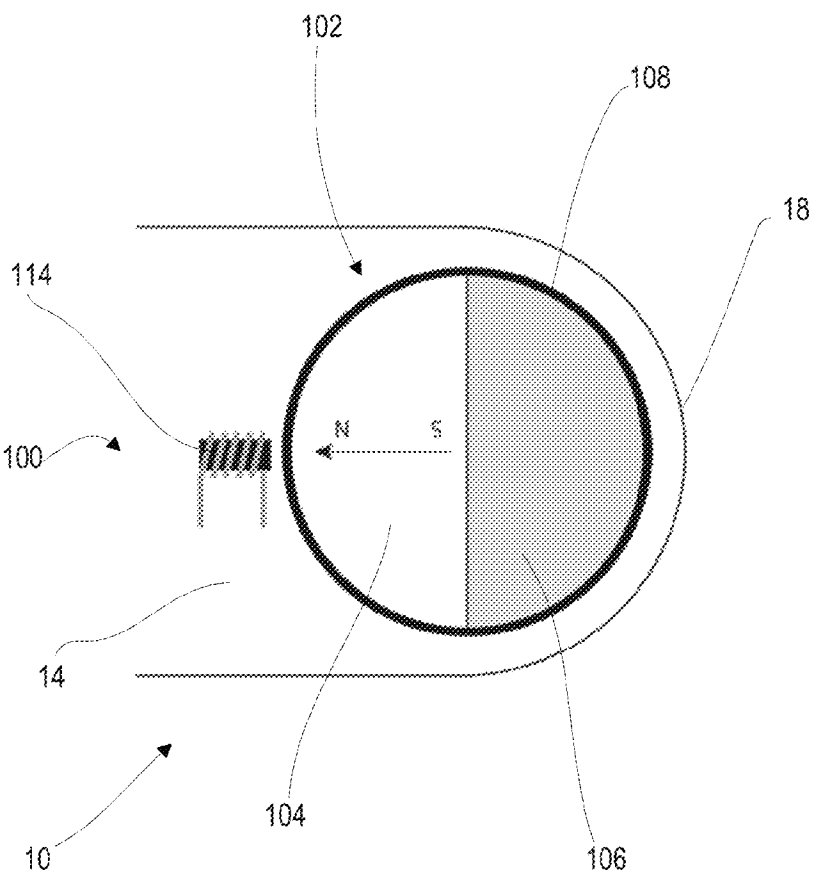

In some embodiments, the biasing member may be electromagnetic. For example, FIG. 10A depicts a device 10 with an electromagnet 114 which serves as a biasing member. Electromagnet 114 includes insulated wire wrapped in a coil around a ferromagnetic core. Flow of electrical current through the wire creates a magnetic field. The magnetic field creates apparent magnetic poles as shown in FIG. 10B, in an orientation dependent on polarity of current flowing through the coiled wire. That is, Current flowing with a first polarity may produce apparent magnetic poles as depicted in FIG. 10B. Conversely, current flowing with the opposite polarity may produce apparent magnetic poles with the opposite orientation.

The coiled wire of electromagnet 114 may be connected to a control unit of device 10. In particular, the control unit may be capable of producing a specific amount and polarity of current flow, which corresponds to a specific magnetic strength and apparent orientation.

When electromagnet 114 is powered down, first portion 104 of anchor 102 magnetically interacts with the ferromagnetic core of electromagnet 114, biasing anchor 102 to its inactive position, as shown in FIG. 10A.

As depicted in FIG. 10B, electromagnet 114 may be activated to repel first portion 104 of anchor 102. That is, current may be passed through the windings surrounding the ferromagnetic core to induce a magnetic field to repel anchor 102 from its inactive position. When so activated, electromagnet 114 causes anchor 102 to rotate from its inactive position toward its active position, as indicated by the arrow in FIG. 10B. Thus, unless electromagnet 114 is powered, electromagnet 114 and anchor 102 resist rotation of anchor 102.

Figure 10C:
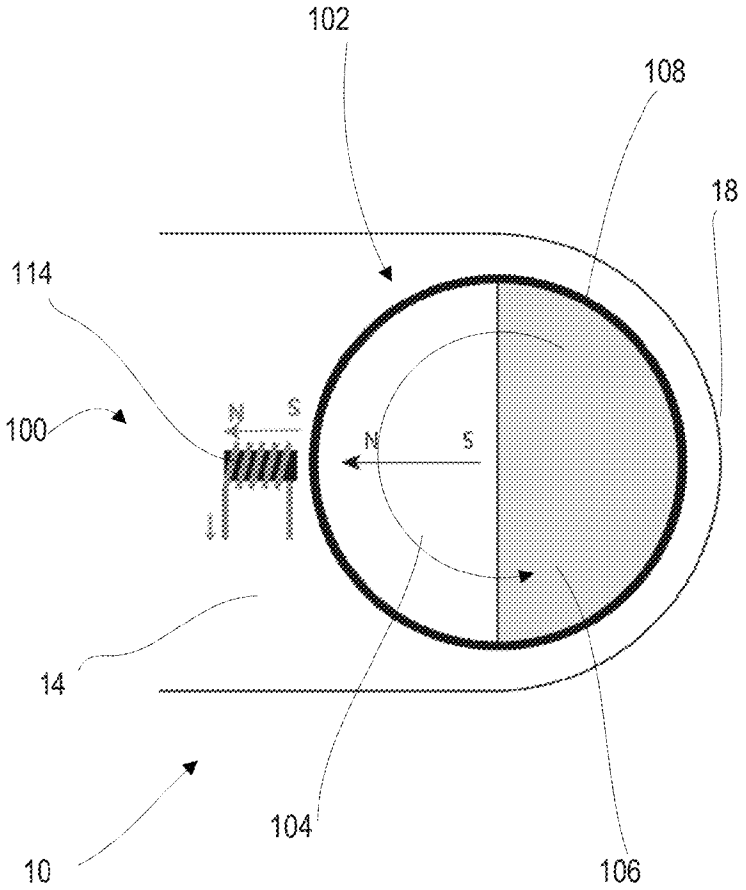

Optionally, electromagnet 114 may be powered with reverse polarity to attract first portion 104 of anchor 102, as shown in FIG. 10C. Specifically, current may be passed through the windings of electromagnet 114 a direction opposite to that of FIG. 10B, to generate a magnetic field with poles reversed relative to FIG. 10B. The resulting magnetic field may attract anchor 102 from its active position to rotate to its inactive position. Optionally, the magnetic field created by powering electromagnet 114 with reverse polarity may be sufficiently strong to hold anchor 102 in its inactive position even if another anchor 102 in its active state is placed adjacent thereto.

Anchor 102 and electromagnet 114 may be configured so that, when electromagnet 114 is unpowered, attraction between anchor 102 and electromagnet 114 (specifically, the ferromagnetic core of electromagnet 114) is sufficient to maintain anchor 102 in its inactive position, even if another anchor 102 in its inactive state is placed adjacent thereto.

Figure 11:
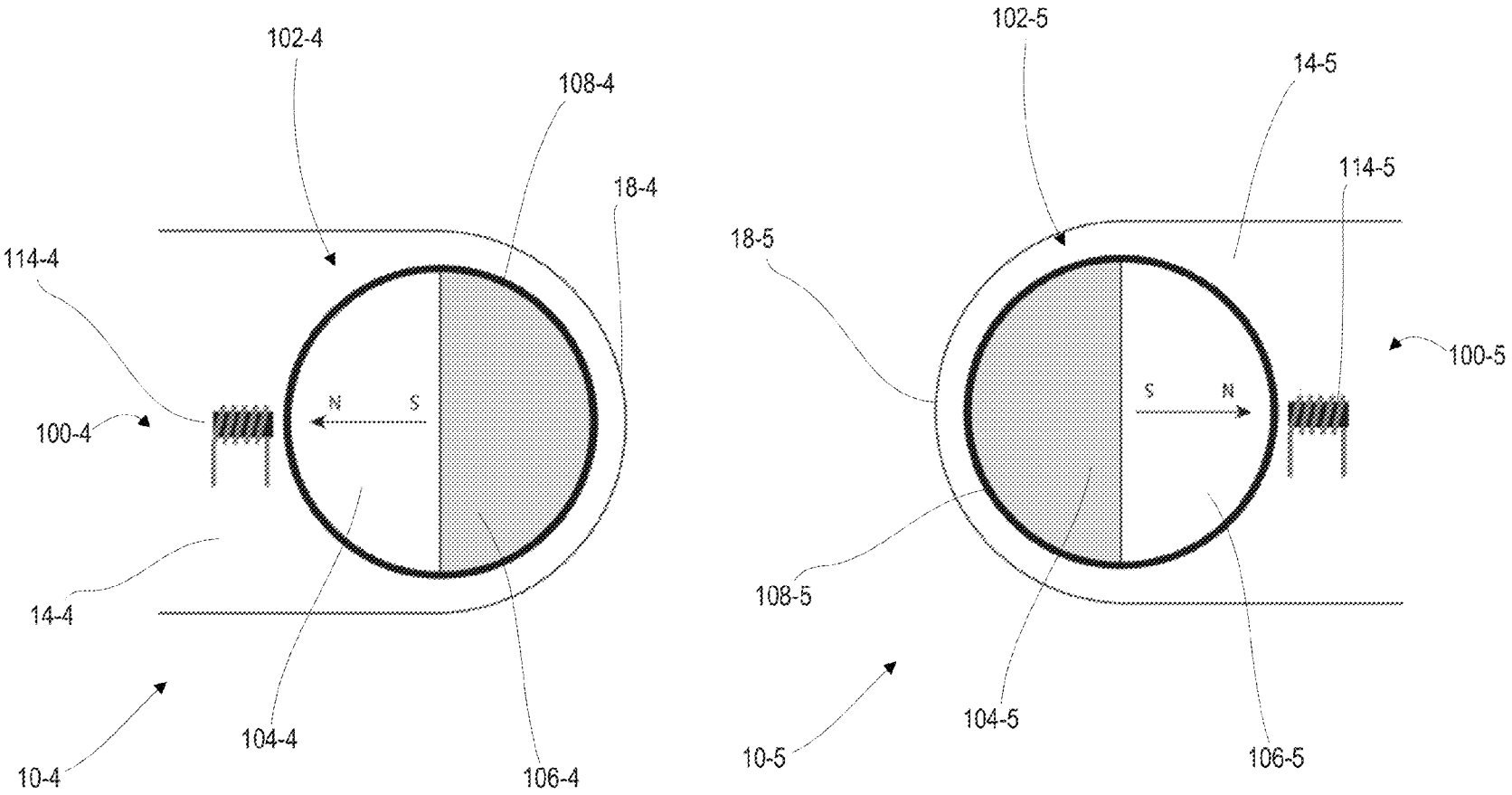
FIG. 11 is a partial side cross-sectional view of two electronic devices with connectors in an inactive operational state.

For example, as shown in FIG. 11, two devices 10-4, 10-5 with anchors 102-4, 102-5 are positioned adjacent one another. First portions 104-4, 104-5 of anchors 102-4, 102-5 magnetically attract one another, with strength influenced by factors such as the magnetic strength and physical proximity of portions 104-4, 104-5. First portions 104-4, 104-5 also attract the ferromagnetic cores of the respective electromagnets 114-4, 114-5, with strength influenced by factors such as the magnetic strength of the respective portion 104; the size of the ferromagnetic core and the physical proximity of electromagnet 114 to anchor 102 (specifically, first portion 104).

In some embodiments, electromagnet 114-4 may be sized and located within housing 14-4 such that anchor 102-4 remains in its inactive position, even when device 10-5 is placed adjacent to device 10-4 with anchor 102-5 in its inactive position. Magnetic attraction between ferromagnetic core of electromagnet 114-4 and anchor 102-4 may be greater than that between biasing member 110-1 and anchor 102-1 of device 10-1. The ferromagnetic core of electromagnet 114-4 may be larger than biasing member 110-1, or electromagnet 114-4 may be positioned closer to anchor 102-4 than biasing member 110-1 is to anchor 102-1.

Figure 12A:
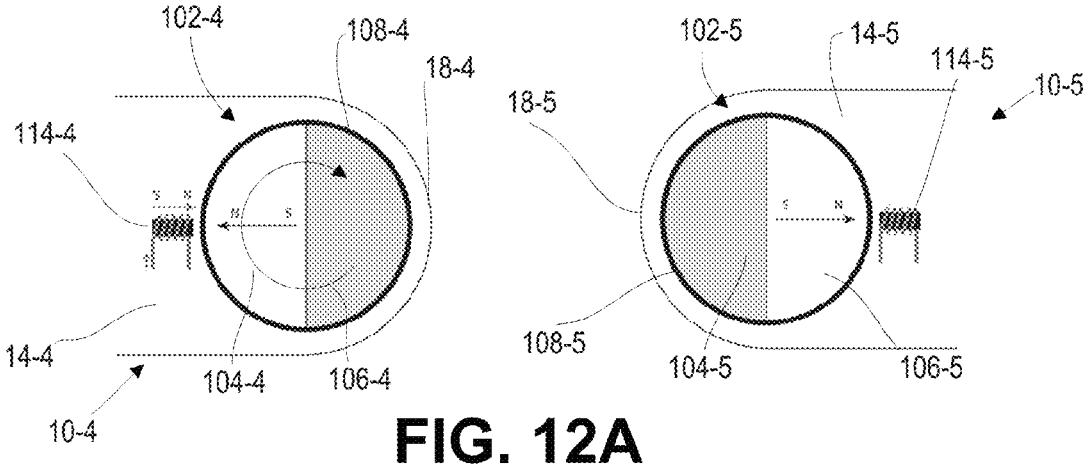
FIGS. 12A-12C are partial side cross sectional views of two electronic devices in different connection states.
Figure 12B:
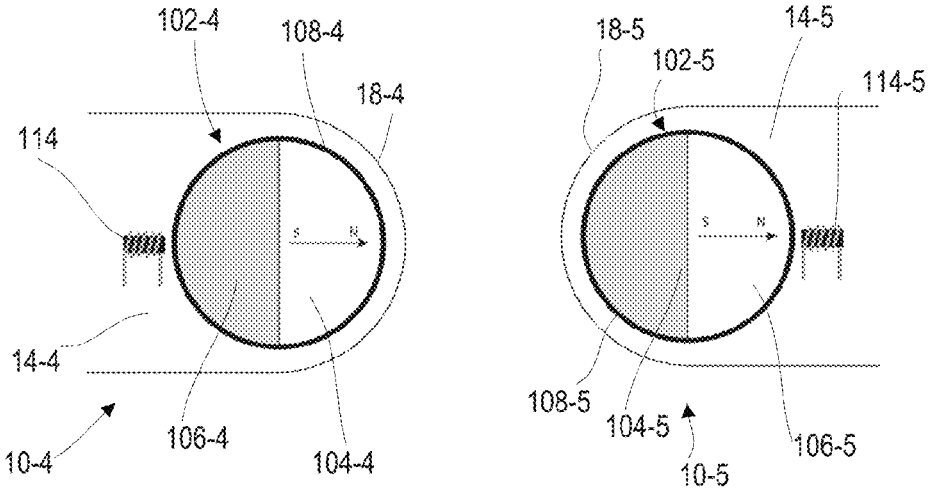
Figure 12C:
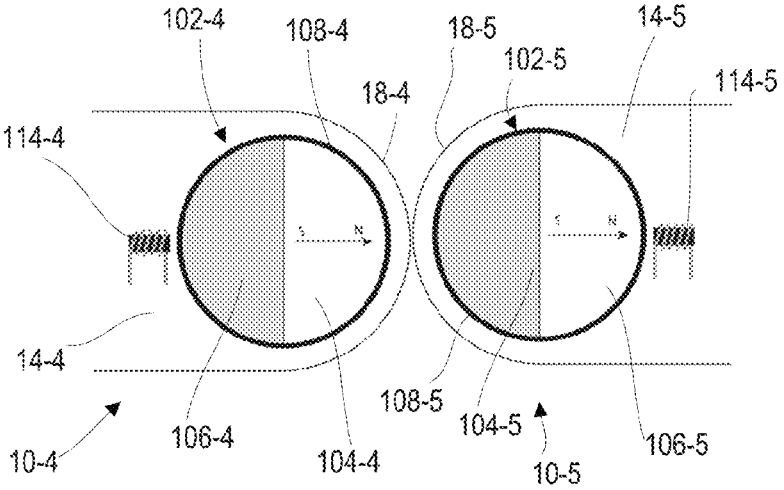

FIGS. 12A, 12B and 12C depict connection of devices 10-4, 10-5. As shown in FIG. 12A, devices 10-4, 10-5 may initially be brought together with anchors 102-4, 102-5 in their inactive positions, biased by the ferromagnetic cores of electromagnets 114-4, 114-5. Electromagnet 114 may then be powered to repel portion 104-4 of anchor 102-4, causing anchor 102-4 to rotate, as indicated by the arrow in FIG. 12A, toward its active position (FIG. 12B).

In its active position, anchor 102-4 magnetically attracts anchor 102-5. In particular, as shown in FIG. 12B, first portion 104-4 of anchor 102-4 and first portion 104-5 of anchor 102-5 are aligned. Devices 10-4, 10-5 are drawn together and connected by magnetic attraction.

Thus, powering of electromagnet 114-4 activates anchor 102-4 in that, once electromagnet 114-4 is activated to repel first portion 104-4, anchor 102-4 assumes a position in which it is capable of attracting and forming a connection with another device.

Powering of electromagnet 114-4 may be done in response to a hardware or software control of device 10-4. For example, electromagnet 114-4 may be powered to allow device 10-4 to form a connection with another device, based, for example, on a user-invoked control such as a button or other input in a software application or a hardware button or switch. Additionally or alternatively, electromagnet 114-4 may be powered after receiving a signal. For example, devices 10-4, 10-5 may exchange wireless signals such as handshake, pairing or authentication signals, e.g., by Bluetooth, Near-field Communication, WiFi or the like, and electromagnet 114-4 may be powered in response to successful completion of such an exchange.

With devices 10-4, 10-5 positioned close together, first portion 104-4 of anchor 102-4 may begin to attract anchor 102-5 at a position intermediate the inactive position of FIG.

12A and the active position of FIG. 12C. Such attraction may be sufficient to pull anchor 102-4 to the position of FIG. 12B. For example, as shown in FIG. 12B, the magnetic orientation of anchor 102-4 is positioned 180 degrees from the magnetic orientation of anchor 102-4 shown in FIG. 12A. However, magnetic attraction between first portion 104-4 and anchor 102-5 may begin to occur when anchor 102-4 passes an orientation approximately 90 degrees from its inactive position. The attraction may pull anchor 102-4 to its active position.

As will be apparent, passing current through the windings of electromagnet 114 consumes energy. Accordingly, the duration in which electromagnet 114-4 is powered on may be limited in order to limit power consumption. For example, an electromagnet 114 may be powered briefly (e.g. several milliseconds) to cause slight rotation of anchor 102-4, after which the electromagnet 114 may be unpowered, and anchor 102-4 may continue its rotation to the active position by attraction with anchor 102-5.

Devices 10-4, 10-5 may be disconnected, for example, by physically pulling apart the devices. After devices 10-4, 10-5 are pulled apart, anchor 102-4 returns to its inactive position due to the biasing effect of electromagnet 114-4. Optionally, after the devices are disconnected, electromagnet 114-4 may be powered in reverse polarity to attract anchor 102-4 from its active position (FIG. 12B-12C) to its inactive position (FIG. 12A).

Optionally, devices may be disconnected by powering electromagnet 114-4 in reverse polarity. Specifically, a current may be passed through the windings of electromagnet 114-4 to create a magnetic field that attracts first portion 104-4 of anchor 102-4. The current may create a sufficiently strong magnetic field to overpower attraction between anchors 102-4, 102-5 such that the connection between the anchors is broken by rotation of anchor 102.

Figure 13A:
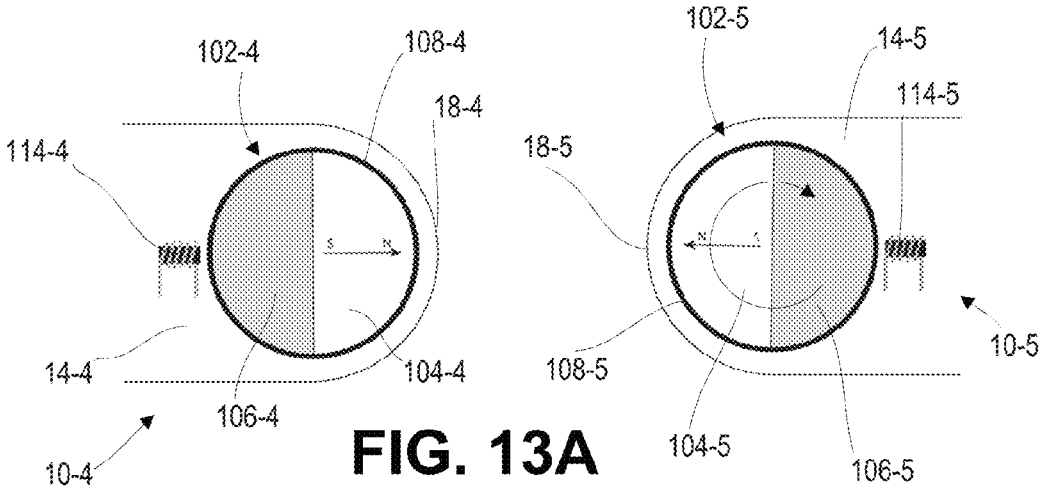
FIGS. 13A-13C are partial side cross sectional views of two electronic devices in different connection states.
Figure 13B:
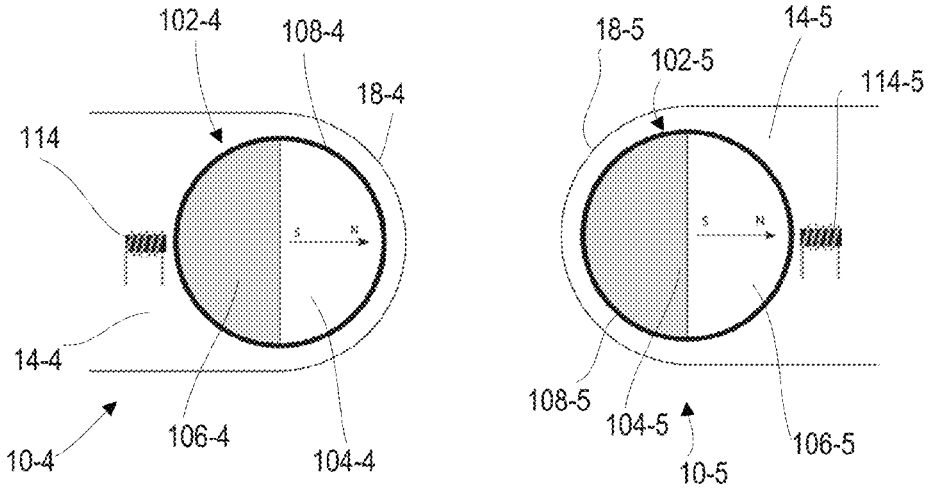
Figure 13C:
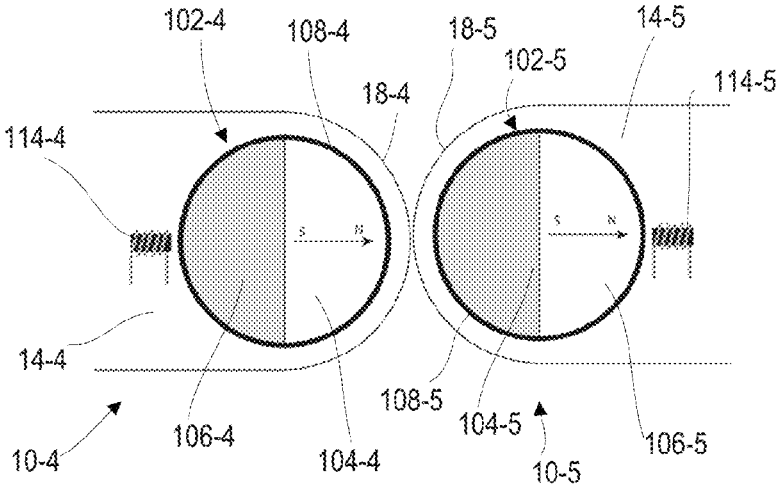

Devices 10-4, 10-5 may also be connected with both of anchors 102-4, 102-5 initially in their active positions. FIGS. 13A-13C depict connection of devices 13-4, 13-5 in such conditions. As shown in FIG. 13A, like magnetic poles of anchors 102-4, 102-5 initially face one another. As devices 10-4, 10-5 are brought together, anchors 102-4, 102-5 initially repel one another, with a strength dependent on the distance between the anchors. Once anchors 102-4, 102-5 are within a threshold distance from one another, one of anchors 102-4, 102-5 begins to rotate from its active position towards its inactive position, shown in FIG. 13B. As the anchor 102 rotates, the first portion 104 moves physically away from the other anchor and the magnetic repulsion decreases. Rotation continues until the magnetic orientation of anchor 102-4 begins to align with that of anchor 102-5, as shown in FIG. 13B. Anchors 102-4, 102-5 then begin to attract one another and form a magnetic connection as shown in FIG. 13C, holding the devices 10 together.

Operation of devices 10 as depicted in FIGS. 11, 12A, 12B, 12C and 13A, 13B, 13C may implement a connection protocol. In particular, as two devices 10 are brought together, a connection will be formed provided at least one anchor 102 is in its active position. That is, if one or both of the two anchors 102-4, 102-5 is in the active position, the anchors will attract one another to connect devices 10-4, 10-5. Conversely, if both of anchors 102-4, 102-5 are in their inactive position, no connection will be formed.

Anchors 102-4, 102-5 may be placed in their active positions only if the respective device 10-4, 10-5 is available for connection. For example, an anchor 102 may be moved to its active position by a user instruction or based on a condition such as receipt of a communication or the like. Undesired or accidental connections between devices may be avoided.

Figure 14:
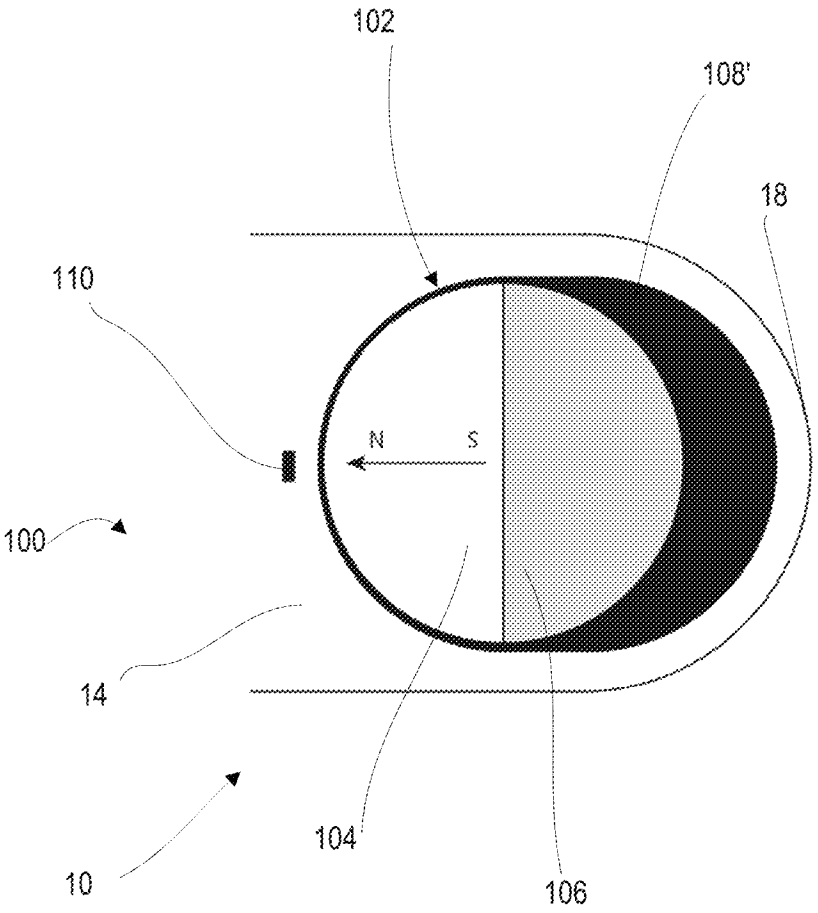
FIG. 14 is a partial side cross-sectional views of another electronic device.

In some embodiments, anchors may be received in a cavity sized to allow translation (e.g. sliding movement) of the anchor. For example, FIG. 14 depicts a device 10' with an elongated cavity 108'. Magnetic attraction between biasing member 110 and anchor 102 may cause anchor 102 to move inwardly away from edge 18 in the inactive state. Displacement of anchor 102 away from edge 18 may further reduce the strength of the magnetic field surrounding edge 18. Conversely, when another device is placed with its anchor adjacent to anchor 102, magnetic attraction between the anchors may draw anchor 102 towards edge 18. In some embodiments, translation of anchor 102 towards edge 18 may cause anchor 102 to press against a signal carrying element, such as a wire, a flat cable, a spring contact or the like. This may bias the signal carrying element outwardly, allowing an electrical connection to be formed with a corresponding element of another device. Alternatively or additionally, this may form an electrical connection between anchor 102 and the signal carrying element, for example, to allow a signal to be passed to an internal circuit of a device 10 through anchor 102.

Figure 15B:
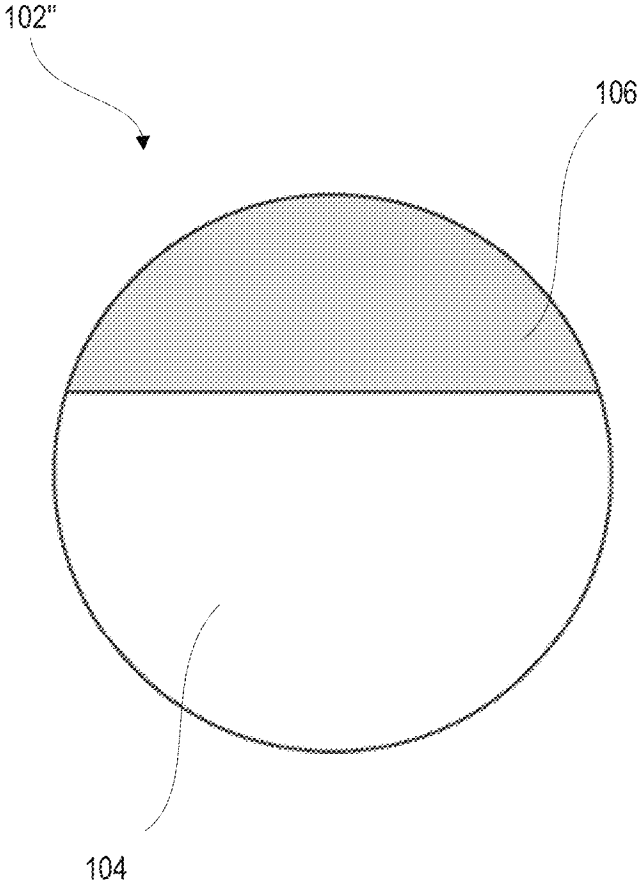
FIGS. 15A-15B are schematic views of anchors of an electronic device.
Figure 15A:
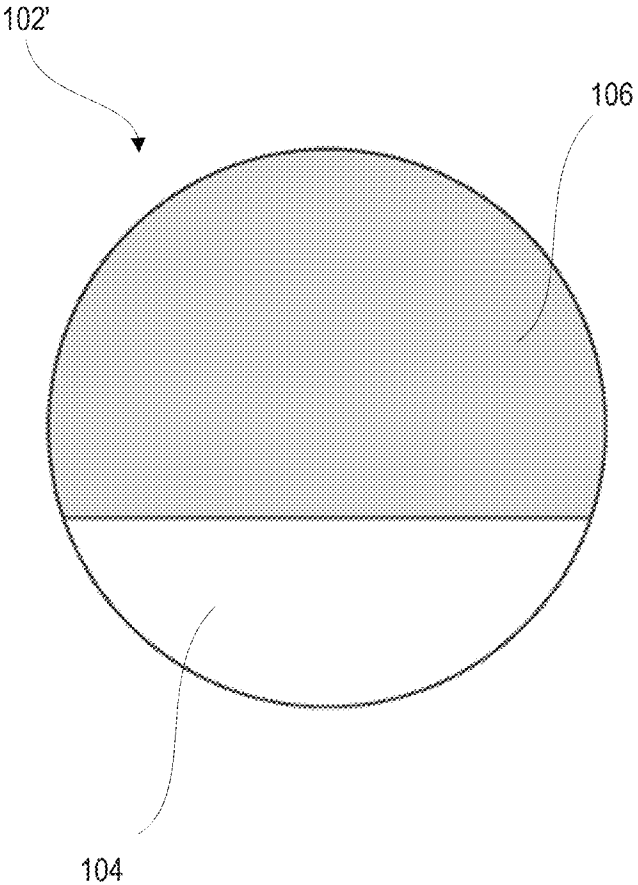

In the above examples, first portion 104 and second portion 106 are approximately the same size. However, in other embodiments, the relative sizes of the first and second portions may be varied. For example, FIG. 15A shows an anchor 102' with a relatively small first portion 104 and larger second portion 106. FIG. 15B shows an anchor 102" with a relatively large first portion 104 and a smaller second portion 106. The sizes of the segments may be selected to present a magnetic field of a desired strength in the active position, e.g. based on a desired strength of connection between devices, and to provide a desired balance of magnetic attraction between first portion 104 and biasing member 110, and between adjacent anchors 102. For example, the relative magnetic attraction between first portion 104 and biasing member 110, and between adjacent anchors 102 may determine the threshold distance at which anchors 102 can attract one another to the active position.

Figure 16A:
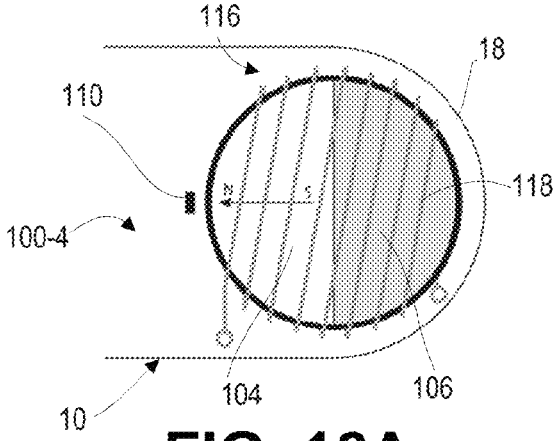
FIGS. 16A-16C are partial side cross-sectional views of another electronic device in different states of operation.
Figure 16B:
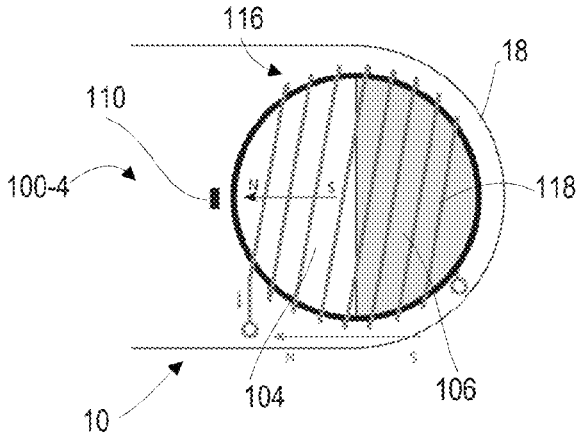
Figure 16C:
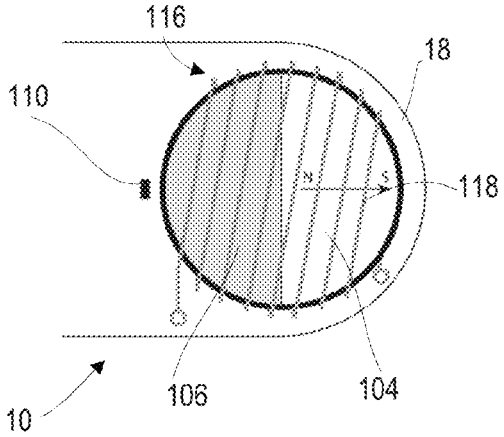

In some embodiments, a conductive coil 118 may be wound around anchor 102, as shown in FIGS. 16A-16C. Electrical current may be passed through coil 118 creating a magnetic field with a desired polarity for magnetically causing anchor 102 to rotate to either the active position or the inactive position. For example, as shown in FIG. 16B, current may be passed through coil 118 to cause the anchor 102 to transition from the inactive position to the active position. Anchor 102 may be returned to the inactive position as shown in FIG. 16C by stopping the current through coil 118 such that magnetic attraction between first portion 104 and biasing member 110 causes rotation of anchor 102, or by passing current through coil 118 in the opposite direction to that of FIG. 16B.

Although the disclosure has been described and illustrated with respect to exemplary arrangements and embodiments with a certain degree of particularity, it is noted that the description and illustrations have been made by way of example only. Numerous changes in the details of construction and combination and arrangement of parts and steps may be made.

What is claimed is:

1. An electronic device comprising:

a housing with an internal cavity proximate an edge of said housing;

an anchor assembly movably mounted inside said cavity, said anchor assembly comprising a magnet portion and a ferromagnetic portion, and having a magnetic field that is stronger proximate said magnet portion than said ferromagnetic portion, said anchor assembly rotatable between a first position with said magnet portion facing said edge of said housing for forming a connection with another electronic device, and a second position with said magnet portion facing away from said edge of said housing; and a biasing member for biasing said anchor assembly to said second position by magnetic attraction.

2. The device of claim 1, wherein magnetic flux at an outer surface of said housing with said anchor assembly in said first position is sufficient to mechanically couple said electronic device with another device, and with said anchor assembly in said second position, is insufficient to mechanically couple said electronic device with another device having another anchor assembly in said second position.

3. The device of claim 1, wherein said housing comprises a curved outer surface and said anchor assembly is operable to maintain a mechanical coupling between said electronic device and another device, as said another device is rotated about said curved outer surface.

4. The device of claim 3, wherein said anchor assembly is rotatable during rotation of said another device to maintain magnetic alignment with said second device.

5. The device of claim 1, wherein said biasing device comprises an electromagnet operable to cause said anchor assembly to transition from said second position to said first position.

6. The device of claim 1, wherein said biasing device is a ferrous block.

7. The device of claim 1, wherein said magnet portion is smaller than said ferromagnetic portion.

8. The device of claim 1, wherein said anchor assembly is cylindrical or spherical.

9. The device of claim 1, wherein said ferromagnetic portion is a non-magnetized ferrous member.

10. A method of connecting a first electronic device to a second electronic device, comprising:

positioning said first electronic device adjacent said second electronic device;

magnetically rotating an anchor assembly within a cavity of said first device from a first position with a magnet portion facing inwardly and a ferromagnetic portion facing outwardly, to a second position with said magnet portion facing outwardly toward said second electronic device for forming a connection, thereby overcoming a magnetic bias to said first position; and magnetically holding said first and second electronic devices together with said anchor assembly.

11. The method of claim 10, comprising rotating said anchor assembly from said first position toward said second position by activating an electromagnet.

12. The method of claim 11, further comprising deactivating said electromagnet prior to said anchor assembly reaching said second position.

13. The method of claim 10, wherein said rotating said anchor assembly comprises attracting said anchor assembly to a magnet of said second electronic device.

14. The method of claim 10, comprising rotating said second electronic device relative to an edge of said first electronic device, while said first and second electronic devices are connected.

15. The method of claim 10, wherein said rotating said anchor assembly increases magnetic field strength proximate an edge of said first magnetic device.

16. The method of claim 10, further comprising positioning a third electronic device adjacent said first and second electronic devices, and further comprising magnetically rotating said anchor assembly to a third position for mutual magnetic attraction between said first, second and third electronic devices to form a connection between said first, second and third electronic devices.

17. A magnetic connector for an electronic device, comprising:

an anchor assembly comprising a magnet portion and a ferromagnetic portion and having a magnetic field that is stronger proximate said magnet portion than said ferromagnetic portion, said anchor assembly configured for mounting inside a cavity of the electronic device, rotatable between a first position with said magnet portion facing inwardly and the ferromagnetic portion facing outwardly and a second position with the magnet portion facing outwardly for forming a connection with another device; and a biasing member for magnetically biasing said anchor assembly to said first position.

18. The magnetic connector of claim 17, wherein said biasing device comprises an electromagnet operable to move said anchor assembly from said second position to said first position.

19. The magnetic connector of claim 17, wherein said biasing device is a ferromagnetic block.

20. The magnetic connector of claim 17, wherein said ferromagnetic portion comprises a non-magnetized ferrous member.

* * * * *